US006770017B1

(12) United States Patent
Leipheimer

(10) Patent No.: US 6,770,017 B1
(45) Date of Patent: Aug. 3, 2004

(54) WEIGHT TRAINING MACHINE

(75) Inventor: Jerry Keith Leipheimer, Pymatuning Township, Mercer County, PA (US)

(73) Assignee: Strive Enterprises, Inc., Canonsburg, PA (US)

( * ) Notice: Subject to any disclaimer, the term of this patent is extended or adjusted under 35 U.S.C. 154(b) by 0 days.

(21) Appl. No.: 09/532,141

(22) Filed: Mar. 21, 2000

(51) Int. Cl.[7] ..... A63B 26/00

(52) U.S. Cl. ..... 482/142; 482/145; 482/93; 482/97; 482/99; 482/100; 482/95; 482/94; 482/101

(58) Field of Search ..... 482/145, 91–97, 482/98, 99, 101, 100, 142, 148

(56) References Cited

U.S. PATENT DOCUMENTS 2,855,199 A * 10/1958 Noland et al. ..... 272/58
4,405,128 A * 9/1983 McLaughlin et al. ..... 272/117
5,106,080 A * 4/1992 Jones ..... 482/97
5,184,991 A * 2/1993 Brangi ..... 482/97
5,286,243 A 2/1994 Lapcevic ..... 482/97
5,616,107 A * 4/1997 Simonson ..... 482/97
5,665,036 A * 9/1997 Hsieh ..... 482/100
5,681,247 A * 10/1997 Webber ..... 482/100
5,749,813 A * 5/1998 Domzalski ..... 482/97
5,961,427 A * 10/1999 Habing et al. ..... 482/96
6,302,833 B1 * 10/2001 Ellis et al. ..... 482/100
6,315,702 B1 * 11/2001 Ikonomopoulos ..... 482/138

* cited by examiner

*Primary Examiner*—Nicholas D. Lucchesi
*Assistant Examiner*—L Amerson
(74) *Attorney, Agent, or Firm*—Webb Ziesenheim Logsdon Orkin & Hanson, P.C.

(57) ABSTRACT

A weight training machine includes a main frame, a lever carriage mechanism, an adjustment linkage and a stop mechanism. A lever carriage mechanism is pivotally connected to the main frame. The lever carriage mechanism includes a weight carrying portion adapted to carry at least one weight. An input mechanism is connected to the lever carriage mechanism. The adjustment linkage is connected between the lever carriage mechanism and the main frame and is configured to selectively adjust an arc of rotation of the weight carrying portion of the lever carriage mechanism about the main frame such that the weight carrying portion may selectively traverse each of a plurality of predefined strength curves in response to movement of the input mechanism by a user.

31 Claims, 19 Drawing Sheets

WEIGHT TRAINING MACHINE

BACKGROUND OF THE INVENTION

1. Field of the Invention

The present invention relates to a weight training machine and, more particularly, to a weight training machine that enables a user to selectively sequence a plurality of strength curves for improved muscle training in the user's body.

2. Description of the Prior Art

Prior art weight training devices typically offer the user of the device a single range of motion, or strength curve. Consequently, each time the user operates the weight training device he or she repeats the same predefined strength curve. Using the weight training devices known in the prior art on a repetitive basis means that the user's workouts lack variety. The same muscle fibers in the user's body, such as the muscles in the user's arms or legs, are conditioned in the same manner during each workout. The person's muscles become accustomed to the training regimen which leads to training plateaus in which the person must work harder and harder with diminishing returns. To achieve increasing benefits over time, the user must either increase the number of repetitions performed or the amount of weight used in the device.

The single resistance pattern weight training devices known in the prior art do not adequately train the user's muscles for realistic physical situations. Whether in the work place, on the athletic field, or in everyday situations people are forced to respond to uncontrolled resistances that impact different ranges of movement of the human body. It is apparent that a single resistance pattern, or strength curve, does not "functionally" prepare the human body for these dynamic and unpredictable stresses.

Therefore, it is an object of the present invention to overcome these disadvantages in prior art weight training devices which offer the user only a single resistance pattern or strength curve. In addition, it is weight training devices which offer the user only a single resistance pattern or strength curve. In addition, it is an object of the present invention to provide a weight training machine that enables the user to selectively sequence a number of strength curves for improved training of the muscles in the user's body. It is a particular object of the present invention to provide a leg press or arm press machine that enables the user to selectively sequence a number of strength curves for improved training of the user's leg or arm muscles. Furthermore, it is another particular object of the present invention to provide an arm curl machine that enables the user to selectively sequence a number of strength curves for improved training of the user's upper arms.

SUMMARY OF THE INVENTION

The above objects are accomplished with a weight training machine made in accordance with the present invention. The weight training machine generally includes a main frame, a lever carriage mechanism, an input mechanism and an adjustment linkage pivotally connected to the lever carriage mechanism and the main frame. The main frame includes a seat portion. The lever carriage mechanism is pivotally connected to the main frame. The lever carriage mechanism also includes a weight carrying portion that is adapted to carry at least one weight. The input mechanism is connected to the lever carriage mechanism. The adjustment linkage is configured to selectively adjust an arc of rotation of the weight carrying portion of the lever carriage mechanism about the main frame such that the weight carrying portion may selectively traverse each of a plurality of predefined strength curves in response to movement of the input mechanism by a user.

The weight training machine may further include a stop mechanism connected to the main frame. The stop mechanism is preferably configured to coact with the lever carriage mechanism such that the stop mechanism limits rotation of the lever carriage mechanism in a direction toward the seat portion of the main frame. The stop mechanism may be pivotally connected to the main frame and include an L-shaped engagement handle for manipulating the stop mechanism.

The lever carriage mechanism may include a main linkage pivotally supported on the main frame by bearings. The lever carriage mechanism may further include a weight mount lever pivotally connected to the main linkage. The weight mount lever preferably includes a weight shaft for receiving one or more removable weights onto the machine. The input mechanism may include a push platform pivotally connected to the main linkage and configured to transmit user input to the machine. The input mechanism may include a handle grip fixedly attached to the main linkage and configured to transmit user input to the machine. Furthermore, the lever carriage mechanism may include a following linkage pivotally connected to the push platform and the main frame. The following linkage may be configured to control an angle of the push platform relative to a horizontal plane as the lever carriage mechanism rotates about the main frame when the machine is operated by the user.

The weight training machine may further include a guide linkage pivotally connected to the adjustment linkage and the weight carrying portion of the lever carriage mechanism. The guide linkage may be configured to guide the weight carrying portion along the preselected strength curve when the machine is operated by a user. The weight carrying portion preferably includes a weight mount lever with a weight shaft for receiving one or more removable weights onto the machine. The guide linkage includes a first end and a second end. The first end of the guide linkage may be pivotally connected to the weight carrying portion of the weight mount lever, and the second end of the guide linkage may be pivotally connected to the adjustment linkage.

An adjustment plate may be fixed to the main frame. The adjustment plate preferably defines a plurality of adjustment holes. The adjustment linkage may define an aperture therethrough. A removable pin may cooperate with the aperture and one of the holes in the adjustment plate to set the arc of rotation of the weight carrying portion of the lever carriage mechanism and the corresponding predefined strength curve. As stated, the adjustment plate may define a plurality of adjustment holes. A first hole of the plurality of adjustment holes preferably corresponds to an overload beginning position of the adjustment linkage. A second hole of the plurality of adjustment holes preferably corresponds to an overload middle position of the adjustment linkage. A third hole of the plurality of adjustment holes preferably corresponds to an overload end position of the adjustment linkage.

The main frame may include a projecting piece. The adjustment linkage may be pivotally connected to the projecting piece. The main linkage may include a counterweight portion at one end thereof. In addition, the main linkage may further include a depending stop member at an end of the main linkage opposite from the counterweight portion. The depending stop member is preferably configured to coact with a stop mechanism connected to the main frame, with the stop mechanism limiting rotation of the lever carriage mechanism toward the seat portion.

Further details and advantages of the present invention will become apparent in the following detailed description, in conjunction with the drawings, wherein similar parts are designated with primed reference characters.

DETAILED DESCRIPTION OF THE PREFERRED EMBODIMENTS

Figure 1:
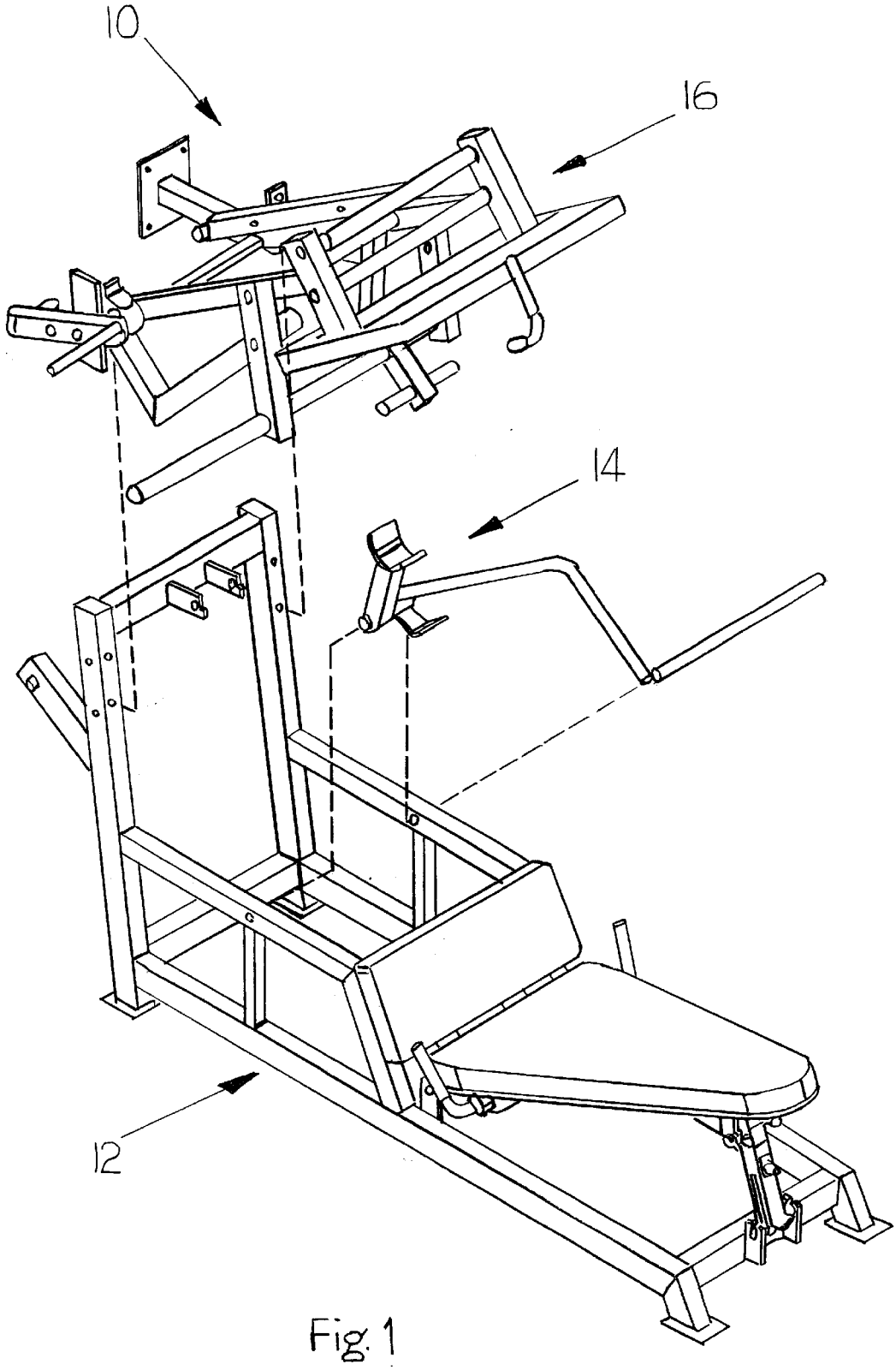
FIG. 1 is an exploded perspective view of a leg press embodiment of the weight training machine according to the present invention.

Referring to FIG. 1, a weight training machine 10 made in accordance with the present invention is shown. The weight training machine 10 shown in FIGS. 1–7 is illustrated as a leg press machine. However, the present invention may also be an arm press machine in which the user's arm and chest muscles are conditioned instead of the user's leg muscles, as discussed herein in connection with FIGS. 8–11. In addition, the present invention is an arm curl machine in which the user's upper arms, in particular, are conditioned, as discussed herein in connection with FIGS. 12–19.

As shown in FIG. 1, the weight training machine 10 generally includes a main frame 12, a stop mechanism 14 connected to the main frame 12, and a lever carriage mechanism 16 connected to the main frame 12 and configured to coact with the stop mechanism 14.

Figure 2:
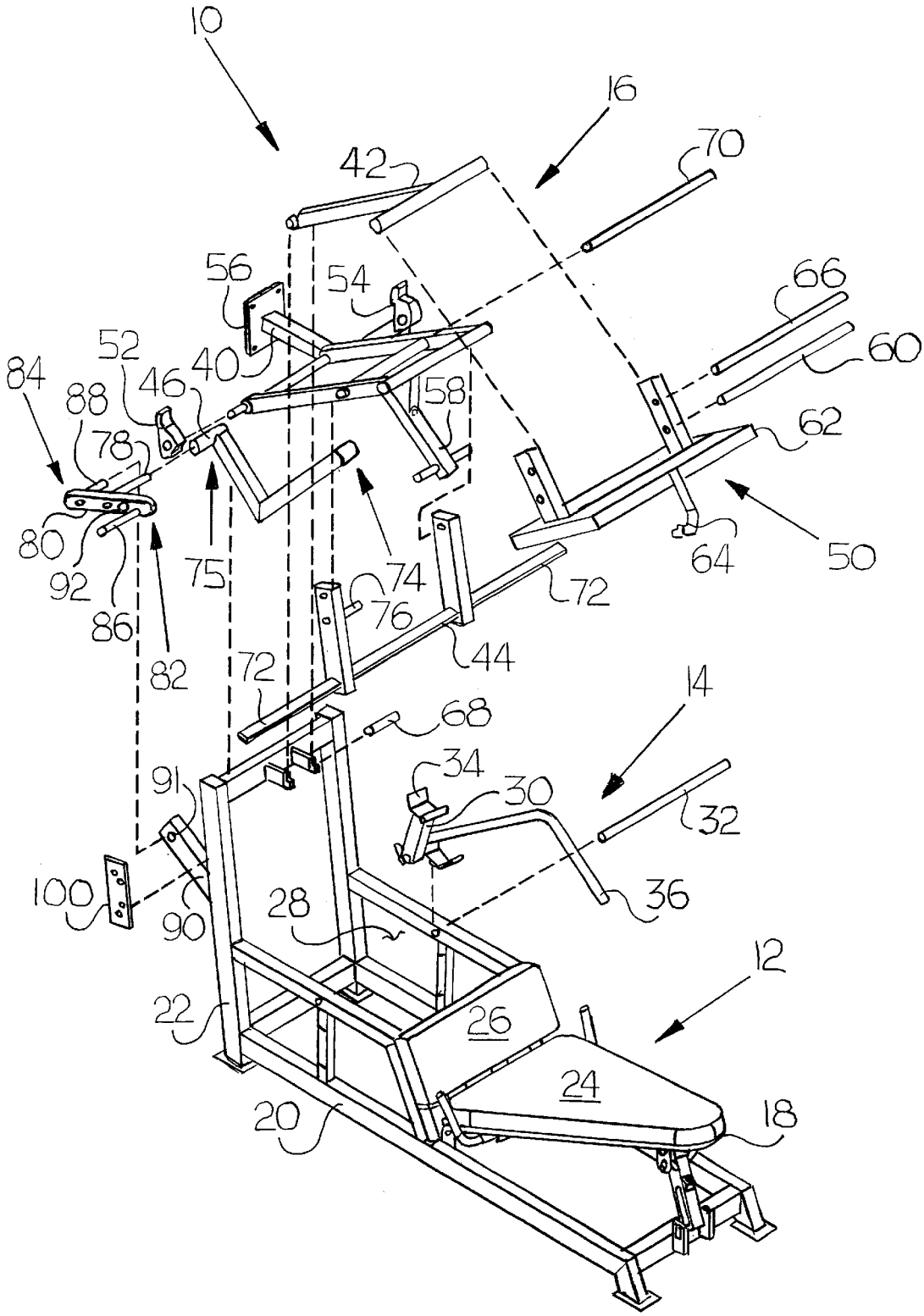
FIG. 2 is an exploded perspective view of the weight training machine of FIG. 1 showing further details of a lever carriage mechanism of the machine.
Figure 3:
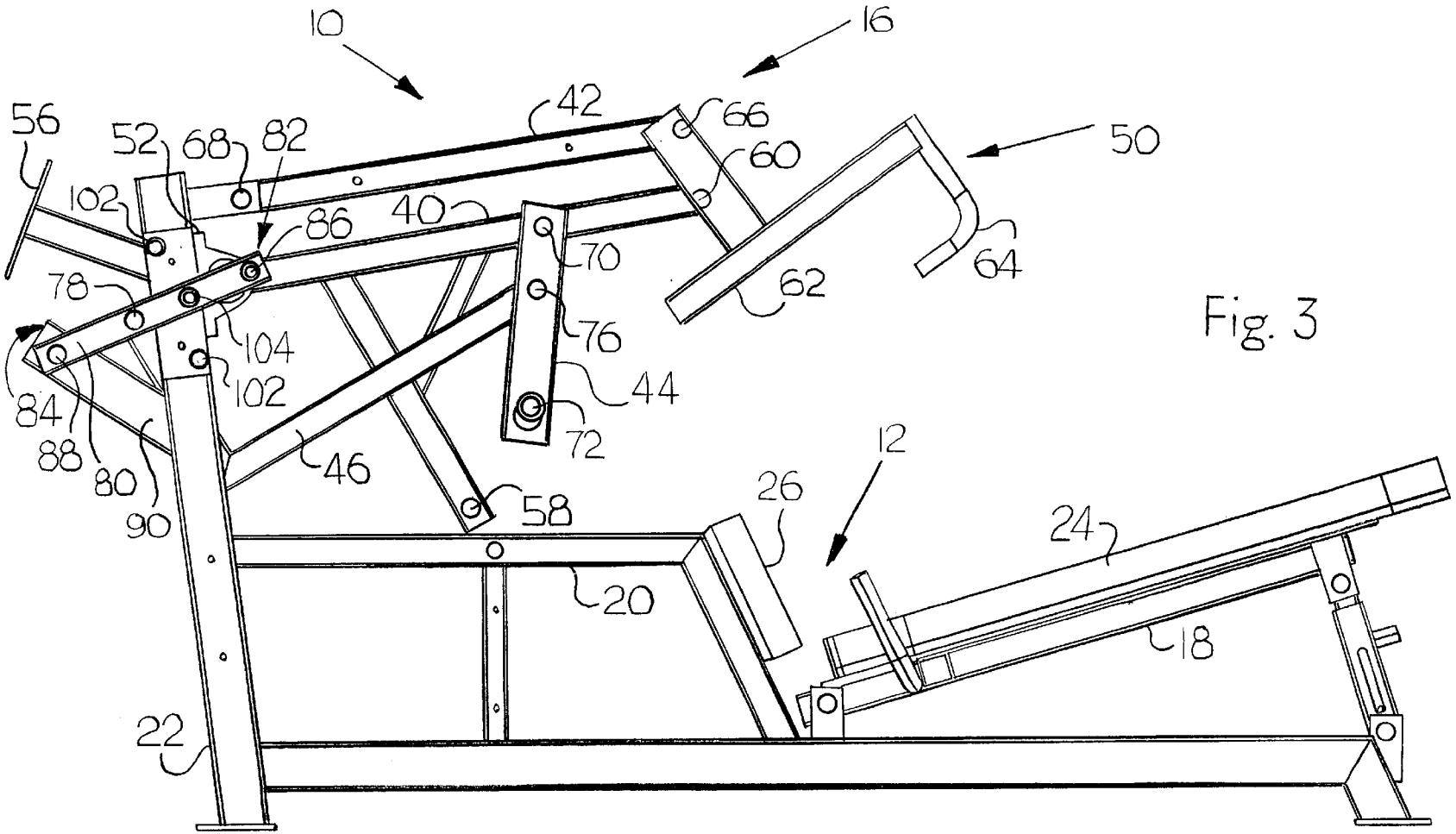
FIG. 3 is a right side elevational view of the weight training machine of FIG. 1.

Referring to FIGS. 1–3, the main frame 12 is substantially rectangular in shape and includes a seat portion 18, a first frame portion 20 adjacent the seat portion 18, and a second frame portion 22 upstanding from the first frame portion 20. The seat portion 18 is configured to receive the torso of a user (not shown) and preferably includes two upholstered pads, a first upholstered pad 24 and a second upholstered pad 26. The user generally uses the weight training machine 10 in the leg press machine embodiment shown in FIGS. 1–7 by placing his or her back against the first upholstered pad 24 and his or her buttocks against the second upholstered pad 26. The first and second upholstered pads 24, 26 provide support to the user during operation of the weight training machine 10.

The first frame portion 20 is formed adjacent and connected to the seat portion 18 and defines an open space 28. The second frame portion 22 is located at an opposite end of the main frame 12 from the seat portion 18 and is connected to the first frame portion 20. The second frame portion 22 generally extends upward from the first frame portion 20 and supports the lever carriage mechanism 16. The main frame 12 generally serves the functions of pivotally supporting the lever carriage mechanism 16 and positioning and supporting the user in a correct exercise position throughout the use of the weight training machine 10.

The stop mechanism 14 generally includes an elongated body 30 that is pivotally connected to the first frame portion 20 by a shaft or a mechanical tube 32. A U-shaped flat bar 34 is provided at one end of the elongated body 30 and is configured to engage the lever carriage mechanism 16 to limit rotation of the lever carriage mechanism 16 in a direction toward the first frame portion 20 and, in particular, toward the seat portion 18 of the main frame 12 for the safety of the user. The stop mechanism 14 further includes a user engagement handle 36 that is connected fixedly to the elongated body 30. The user engagement handle 36 is preferably formed with a 90° angle so that it is easily grasped by the user when positioned in the weight training machine 10. The stop mechanism 14 is generally positioned in the open space 28 defined by the first frame portion 20. The stop mechanism 14 is omitted in FIGS. 3–7 for clarity.

The lever carriage mechanism 16 generally includes a main linkage 40 pivotally connected to the main frame 12, a following linkage 42 pivotally connected to the second frame portion 22, a weight mount lever 44 pivotally connected to the main linkage 40, and a guide linkage 46, also pivotally connected to the main linkage 40. The lever carriage mechanism 16 preferably further includes a push platform 50 pivotally connected to the main linkage 40 and the following linkage 42. The push platform 50 is the main input mechanism in the leg press embodiment of the weight training machine 10, whereby the user exerts his or her leg muscles in a reciprocating manner to pivot the lever carriage mechanism 16 and thus raise and lower the weight mount lever 44.

The main linkage 40 is supported on the main frame 12 by bearings 52, 54. In particular, the main linkage 40 is pivotally connected to the second frame portion 22 of the main frame 12 by bearings 52, 54. Bearings 52, 54 have flanges (not shown) to receive bolts (not shown) for securing the bearings 52, 54 to the second frame portion 22. The main linkage 40 further includes a counterweight portion 56 and a depending stop member 58 that is configured to cooperate with the U-shaped flat bar 34 of the stop mechanism 14. As stated previously, the stop mechanism 14 limits the rotation of the lever carriage mechanism 16 in the direction toward the first frame portion 20. The push platform 50 is pivotally connected to the main linkage 40 by shaft 60. The push platform 50 preferably includes a plate 62 against which the user places his or her feet to provide the input to the weight training machine 10 in the leg press machine embodiment shown. The push platform 50 preferably further includes a handle grip 64 attached to the plate 62 which is used to assist in entry and exit to and from the machine 10. The counterweight portion 56 offsets the weight of the lever carriage mechanism 16 so that the user only "feels" the force generated by the target loading portion of the lever carriage mechanism 16, which generally includes the main linkage 40, the weight mount lever 44 and the guide linkage 46.

Figure 4:
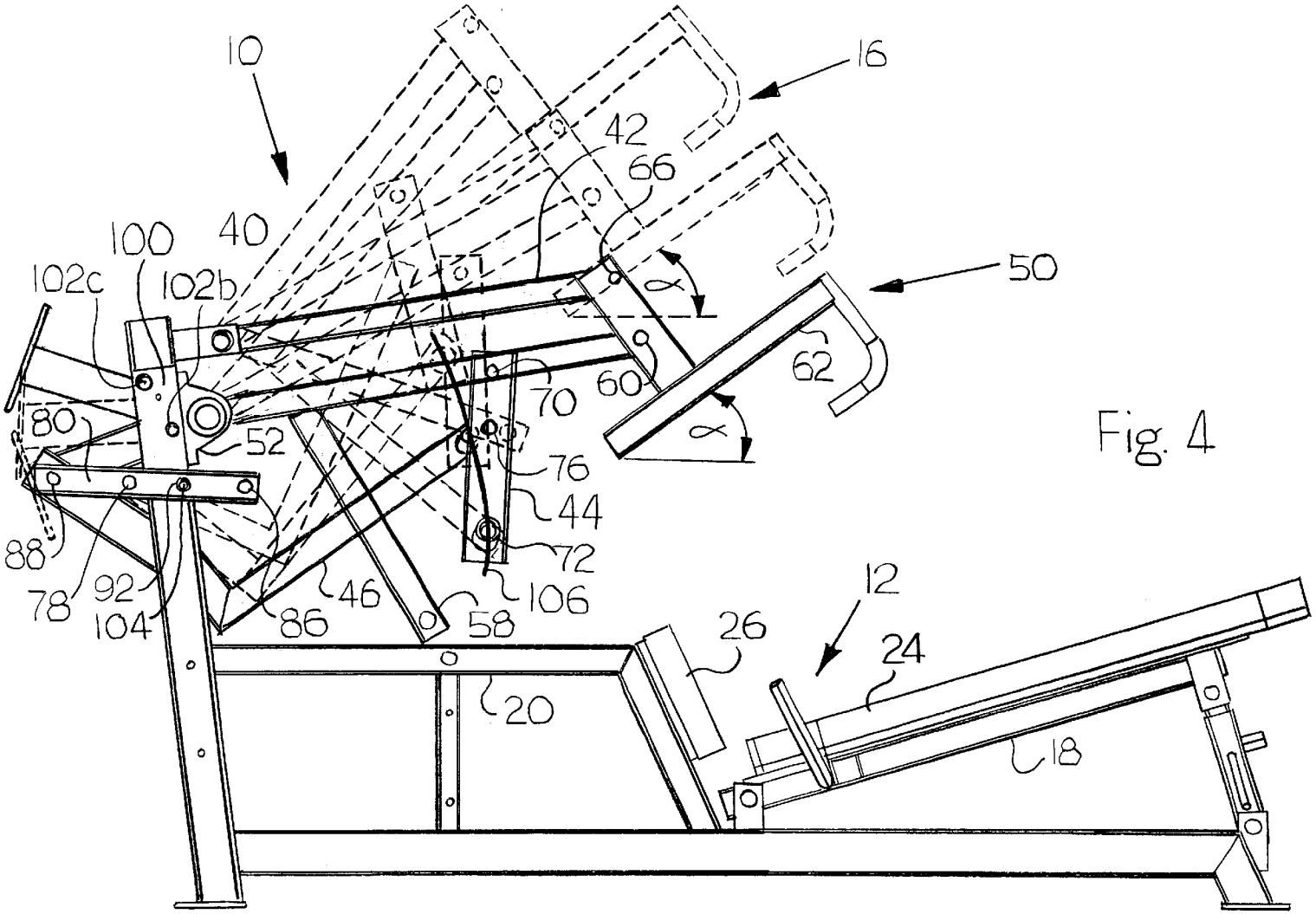
FIG. 4 is a right side elevational view of the weight training machine of FIG. 1 with an adjustable linkage of the machine set in an overload beginning position and showing a range of motion of the lever carriage mechanism in phantom.
Figure 5:
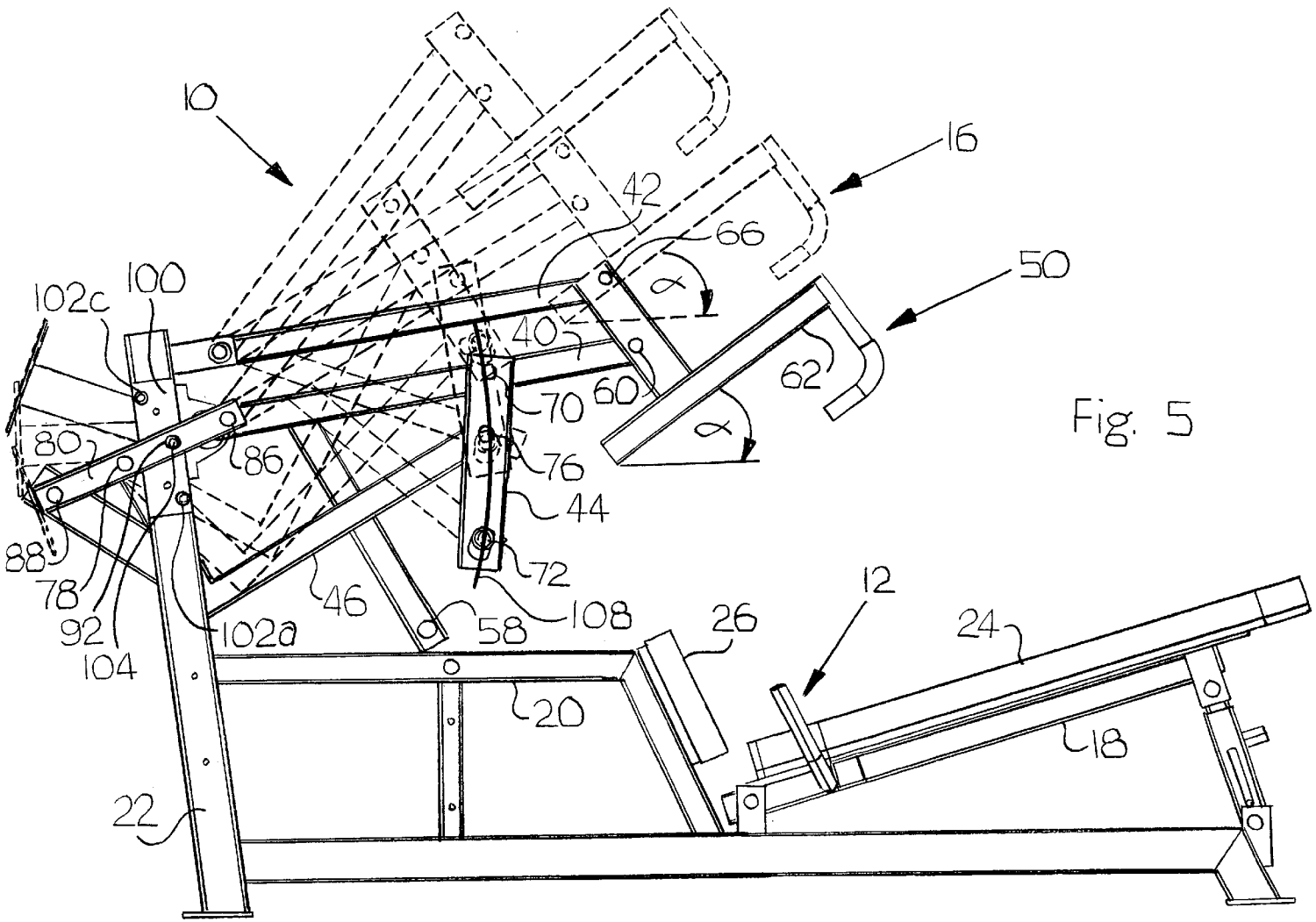
FIG. 5 is a right side elevational view of the weight training machine of FIG. 1 with the adjustable linkage of the machine set in an overload middle position and showing the range of motion of the lever carriage mechanism in phantom.
Figure 6:
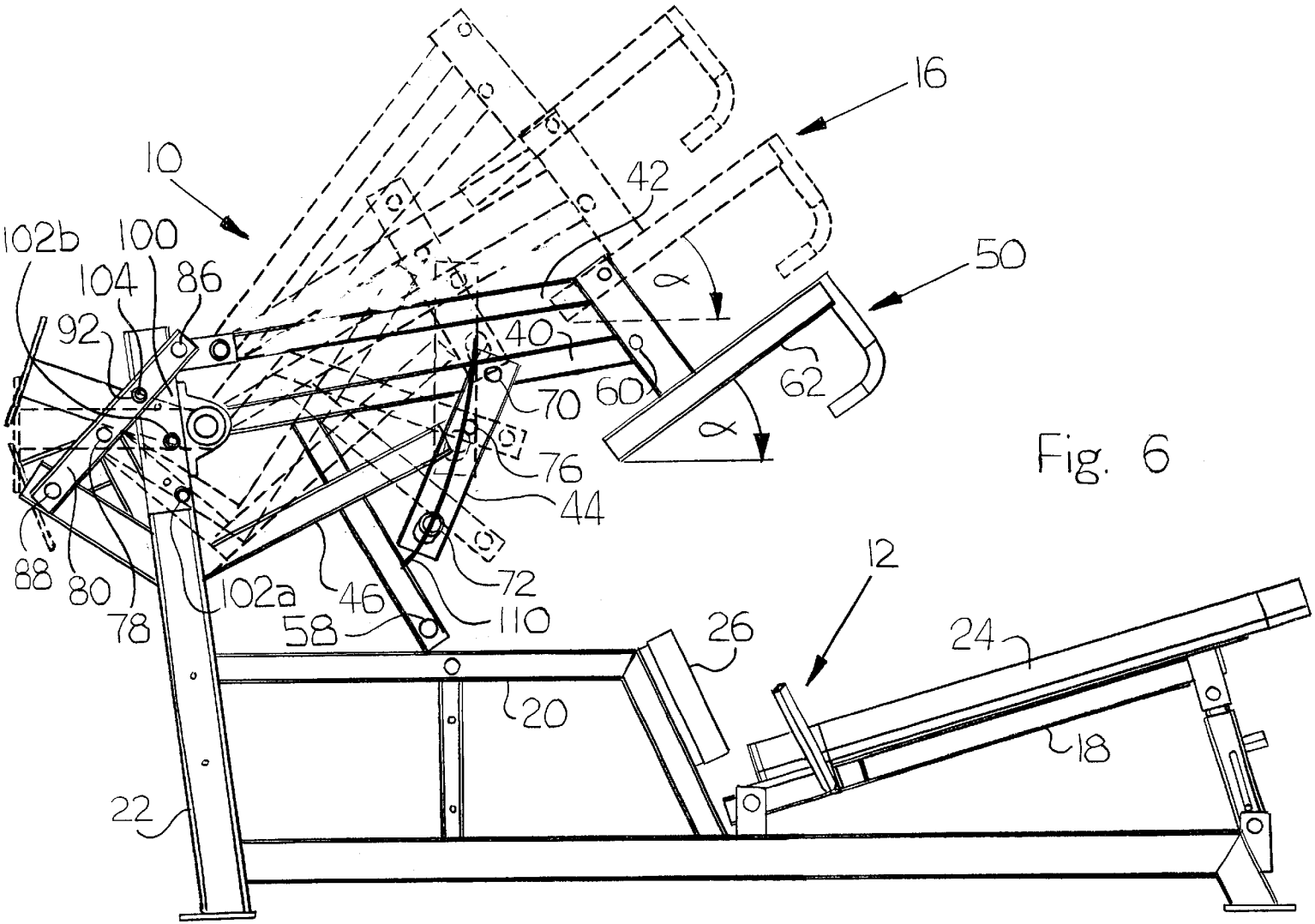
FIG. 6 is a right side elevational view of the weight training machine of FIG. 1 with the adjustable linkage of the machine set in an overload end position and showing the range of motion of the lever carriage mechanism in phantom.

Referring now to FIGS. 1–7, the following linkage 42 is pivotally connected to the push platform 50 by shaft 66 and pivotally connected to the second frame portion 22 of the main frame 12 by shaft 68. The following linkage 42 controls an angle $\alpha$ of the plate 62 of the push platform 50 as the main linkage 40 pivots about the second frame portion 22. The angle $\alpha$ is defined with respect to a horizontal plane, as shown in FIGS. 4–6. The following linkage 42 is configured to maintain the plate 62 oriented at the angle $\alpha$ as the user pushes against the push platform 50 and the plate 62, and the lever carriage mechanism 16 rotates upward through its range of motion. As shown in FIGS. 4–7, the lever carriage mechanism 16 pivots through about 40° of pivotal or rotational motion (i.e., has about a 40° range of motion)

The weight mount lever 44 is pivotally connected to the main linkage 40 by shaft 70. The weight mount lever 44 preferably includes two transversely extending weight mount shafts 72 that are configured to receive removable weights usually in the form of plates with central apertures, (not shown) used in connection with the weight training machine 10. Thus, in the preferred embodiment, the weight mount shafts 72 and the weight mount lever 44 are the weight carrying portion of the lever carriage mechanism 16.

The guide linkage 46 is formed as an L-shaped member and includes two ends, a first end 74 and a second end 75. The first end 74 of the guide linkage 46 is pivotally connected by shaft 76 to the weight mount lever 44. The second end 75 of the guide linkage 46 is pivotally connected by shaft 78 to an adjustment linkage 80. The first end 74 of the guide linkage 46 is connected by shaft 76 at a point on the weight mount lever 44 located between shaft 70 and weight mount shaft 72. The connection point of the guide linkage 46 to the weight mount lever 44 is about four inches away from shaft 70.

The adjustment linkage 80 includes two ends, a first end 82 and a second end 84. An adjustment handle lever 86 is preferably connected to the first end 82 of the adjustment linkage 80 and may be formed integrally therewith. The second end 84 of the adjustment linkage 80 is pivotally connected by shaft 88 to the second frame portion 22 of the main frame 12. In particular, the second end 84 of the adjustment linkage 80 is pivotally connected by shaft 88 to a projecting piece 90 connected to the second frame portion 22. The projecting piece 90 includes a mechanical tube 91 with which shaft 88 cooperates to connect the adjustment linkage 80 to the projecting piece 90.

The guide linkage 46 is rotatable relative to the adjustment linkage 80 via shaft 78, as discussed previously. In particular, the guide linkage 46 is connected at its second end 75 via shaft 78 to the adjustment linkage 80 at a point on the adjustment linkage 80 located between the first end 82 and the second end 84 of the adjustment linkage 80. Preferably, the guide linkage 46 is connected by shaft 78 at a point closer to the second end 84 of the adjustment linkage 80. The connection point of the guide linkage 46 via shaft 78 to the adjustment linkage 80 is about 5¼ inches from the second end 84 of the adjustment linkage 80. However, this relative distance for the connection point is merely an example and may be changed to place the weight mount lever 44 in different locations allowing it to rotate in a proper relation throughout the range of motion of the lever carriage mechanism 16.

The adjustment linkage 80 defines at least one aperture 92 at a point located between the adjustment handle lever 86 and shaft 78 which connects the guide linkage 46 to the adjustment linkage 80. The adjustment linkage 80 is configured to coact with an adjustment plate 100 attached to the second frame portion 22 of the main frame 12 as hereinafter discussed. As shown in FIG. 3, the adjustment plate 100 defines a plurality of holes 102. The adjustment linkage 80 preferably cooperates with the adjustment plate 100 through the use of a removable pin 104, such as a "popper pin", that extends through the aperture 92 in the adjustment linkage 80 and through one of the holes 102 in the adjustment plate 100. The pin 104 is removable so that after removal the adjustment linkage 80 may be moved to other locations along the adjustment plate 100 by manipulating the adjustment handle lever 86. Once the adjustment linkage 80 is moved to a new position in which the aperture 92 lies coextensive with one of the other holes 102 in the adjustment plate 100, the pin 104 is reinserted through the aperture 92 in the adjustment linkage 92 and the "new" hole 102.

As shown in FIGS. 4–6, in the weight training machine 10, the adjustment linkage 80 may be placed in at least three different positions. The three positions of the adjustment linkage 80 in FIGS. 4–6 are merely illustrative and fewer or greater numbers of positions are within the scope of the present invention. Each of the three positions corresponds to one of the holes 102 in the adjustment plate 100. FIG. 4 shows the adjustment linkage 80 set in an overload beginning position corresponding to hole 102*a* in the adjustment plate 100. FIG. 5 shows the adjustment linkage 80 set in an overload middle position corresponding to hole 102*b* in the adjustment plate 100. Finally, FIG. 6 shows the adjustment linkage 80 in an overload end position corresponding to hole 102*c* in the adjustment plate 100. As discussed hereinabove, the pin 104 may be inserted through the aperture 92 in the adjustment linkage 80 and any one of the holes 102*a*, 102*b* and 102*c*. Locating the pin 104 in the respective holes 102*a*, 102*b* and 102*c* in the adjustment plate 100 enables the user to operate the weight training machine 10 in the different overload positions shown in FIGS. 4–6. The overload positions of the adjustment linkage 80 as set by holes 102*a*, 102*b* and 102*c* and popper pin 104 shown in FIGS. 4–6 cause the weight mount shaft 72 of the weight mount lever 44 to traverse different arcs as the user makes inputs to the weight training machine 10, as discussed hereinafter in connection with FIGS. 5 and 7. FIG. 4 shows the weight mount shaft 72 traversing a first arc 106 when the adjustment linkage 80 is set in the overload beginning position corresponding to hole 102*a* in the adjustment plate 100. FIG. 5 shows the weight mount shaft 72 traversing a second arc 108 when the adjustment linkage 80 is set in the overload middle position corresponding to hole 102*b* in the adjustment plate 100. Finally, FIG. 6 shows the weight mount shaft 72 traversing a third arc 110 when the adjustment linkage 80 is set in the overload end position corresponding to hole 102*c* in the adjustment plate 100. The first arc 106, the second arc 108 and the third arc 110 each correspond to a different resistance pattern or strength curve for the weight training machine 10, which enables the user to selectively stress different muscles in the user's body, and in the leg press machine embodiment of the weight training machine 10 to selectively stress different muscles in the user's legs.

The relative movement of the linkages of the lever carriage mechanism 16 will now be discussed with reference to FIGS. 5 and 7, in which the adjustment linkage 80 is set in the overload middle position corresponding to hole 102*b* in the adjustment plate 100. The user mounts the leg press machine embodiment of the weight training machine 10 by placing his or her back against the first upholstered pad 24 and his or her buttocks against the second upholstered pad 26. The user then places his feet against the plate 62 of the push platform 50 and pushes against the push platform 50 using the hamstrings, gluteus maximus and the quadricep muscles to slowly raise the push platform 50. The user will feel close to about 100% of the maximum resistance load of the weights received on the weight mount shafts 72 throughout the range of motion of the lever carriage mechanism 16. The resistance load may vary by about 10° through the range of motion. The input to the push platform 50 causes the main linkage 40 to rotate about bearings 52, 54 and, in particular, to rotate upward about the second frame portion 22 of the main frame 12. The following linkage 42, which is pivotally connected to the push platform 50, controls the angle $\alpha$ of the plate 62 of the push platform 50 relative to a horizontal plane as the main linkage 40 rotates about the bearings 52, 54. The plate 62 of the push platform 50 rotates upward at the angle $\alpha$ which remains unchanged throughout the exercise movement. The angle $\alpha$ is preferably about 30°. Thus, as shown in phantom in FIGS. 4–6, the plate 62 of the push platform 50 remains at a constant angle $\alpha$ to horizontal throughout the exercise movement.

Figure 7:
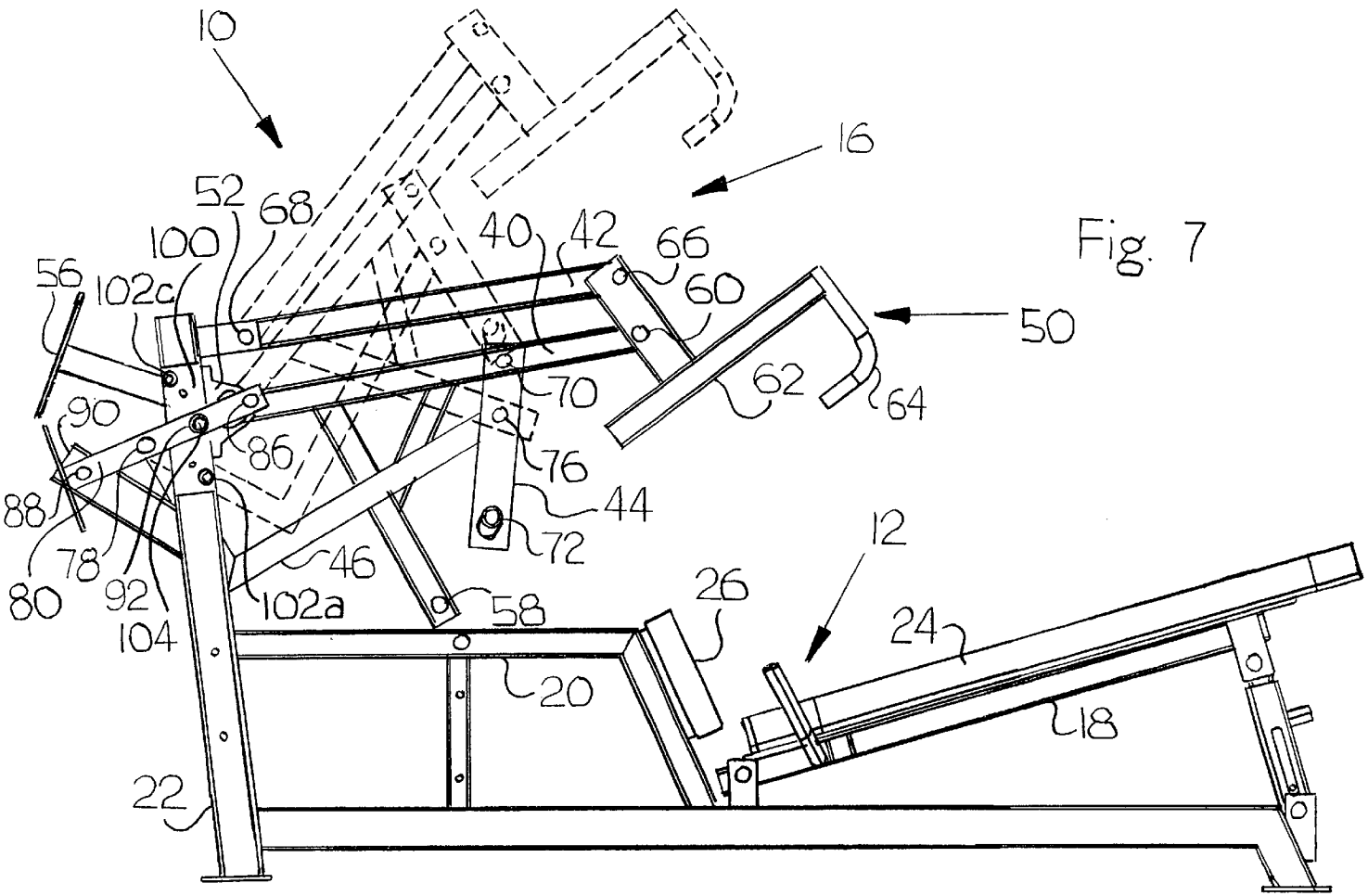
FIG. 7 is a right side elevational view of the weight training machine of FIG. 4 showing the lever carriage mechanism at a beginning point and an ending point in its range of motion.

With continued reference to FIGS. 5 and 7, as the main linkage 40 rotates about bearings 52, 54, the weight mount lever 44 rotates upward with the main linkage 40. The weight mount shaft 72 (which bears weight plates, not shown) of the weight mount lever 44 traverses the second arc 108. The first end 74 of the guide linkage 46, which is pivotally connected to the weight mount lever 44 by shaft 76, pivots upward with the weight mount lever 44. The second end 75 of the guide linkage 46 is pivotally connected to the adjustment linkage 80 via shaft 78 and pivots downward as the first end 74 pivots upward with the weight mount lever 44. The adjustment linkage 80 controls the arc traversed by the weight mount shaft 72 via the guide linkage 46. The angle and location of the adjustment linkage 80 are changed by selectively positioning the pin 104 in the aperture 92 in the adjustment linkage 80 and the respective holes 102 in the adjustment plate 100. The changes in angle and location of the adjustment linkage 80 are selectively variable inputs to the machine 10. The changes in angle and location of the adjustment linkage 80 are transmitted through the guide linkage 46 to the rest of the lever carriage mechanism 16. The changes in angle and location of the adjustment linkage 80, as inputted through the guide linkage 46, alter the arc traversed by the weight mount shaft 72. As stated previously, the overload middle position shown in FIGS. 5 and 7 corresponds to hole 102*b* in the adjustment plate 100, with the pin 104 positioned in the aperture 92 in the adjustment linkage 80 and hole 102*b*. The weight mount shaft 72 traverses the second arc 108, with the adjustment linkage 80 in this configuration.

Referring briefly to FIG. 4, when the adjustment linkage 80 is set in the overload beginning position with the pin 104 inserted in aperture 92 and hole 102*a*, the weight mount shaft 72 of the weight mount lever 44 traverses the first arc 106 and, hence, a different strength curve. The user will feel approximately 100% of the resistance load of the weights received on the weight mount shafts 72 at the beginning of the range of motion of the lever carriage mechanism 16 and the resistance will decrease through the range of motion to about 34% of the maximum resistance at the end (top) of the range of motion of the lever carriage mechanism 16. The resistance load may vary by about 10% through the range of motion. Similarly, as shown in FIG. 6, when the adjustment linkage 80 is set in the overload end position with the pin 104 inserted in aperture 92 and hole 102*c*, the weight mount shaft 72 of the weight mount lever 44 traverses the third arc 110 corresponding to another strength curve. The user will feel about 34% of the maximum resistance load of the weights received on the weight mount shafts 72 at the beginning of the range of motion of the lever carriage mechanism 16, and the resistance will increase through the range of motion to about 100% of the maximum resistance at the end (top) of the range of motion of the lever carriage mechanism 16. The resistance load may vary by about 10% through the range of motion. The adjustment linkage 80 with the pin 104 coacting with the respective holes 102*a*, 102*b* and 102*c* in the adjustment plate 100 controls the respective strength curve or arc traversed by the weight mount shaft 72 of the weight mount lever 44 and, more generally, the range of motion of the lever carriage mechanism 16.

As shown in FIGS. 4–6, the weight mount shaft 72 of the weight mount lever 44 rotates upward to define the respective first arc 106, the second arc 108 and the third arc 110. As stated previously, the first arc 106, the second arc 108 and the third arc 110 each correspond to a predefined strength curve of the weight training machine 10, which are each intended to stress certain muscles (and different parts of the same muscle) in the user's legs more heavily than others. In this manner, the user may vary his or her workout regimen when using the leg press embodiment of the present invention. For example, the first arc 106 corresponds to a strength curve in which the majority of the work done by the user is done at the beginning of the movement of the lever carriage mechanism 16. Consequently, with the adjustment linkage 80 set in the overload beginning position, the user will work, for example, hamstrings and quadricep muscles more so than the gluteus maximus muscles. Similarly, with the adjustment linkage 80 set in the overload middle position and the weight mount shaft 72 traversing the second arc 108 shown in FIG. 5, the user's work input is approximately constant throughout the upward movement of the lever carriage mechanism 16. Consequently, with the adjustment linkage 80 set in the overload middle position, the user will work his or her lower torso muscles evenly throughout the exercise movement. Finally, with the adjustment linkage 80 set in the overload end position and the weight mount shaft 72 traversing the third arc 110 shown in FIG. 6, the user's work input is greater at the end of the upward movement of the lever carriage mechanism 16. Consequently, with the adjustment linkage 80 set in the overload end position, the user will work the gluteus maximus muscles more so than the hamstring and quadricep muscles, for example. By selectively positioning the adjustment linkage 80, the user of a leg press machine may selectively target different muscles and muscle parts in the user's legs.

The exercise movement is completed by lowering the push platform 50 while at the same time rotating the stop mechanism 14 so that the stop member 58 connected to the main linkage 40 is placed in engagement with the U-shaped flat bar 34 of the stop mechanism 14. The stop mechanism 14 limits the downward rotation of the lever carriage mechanism 16 for ease and safety of user entry and exit from the weight training machine 10.

Figure 8:
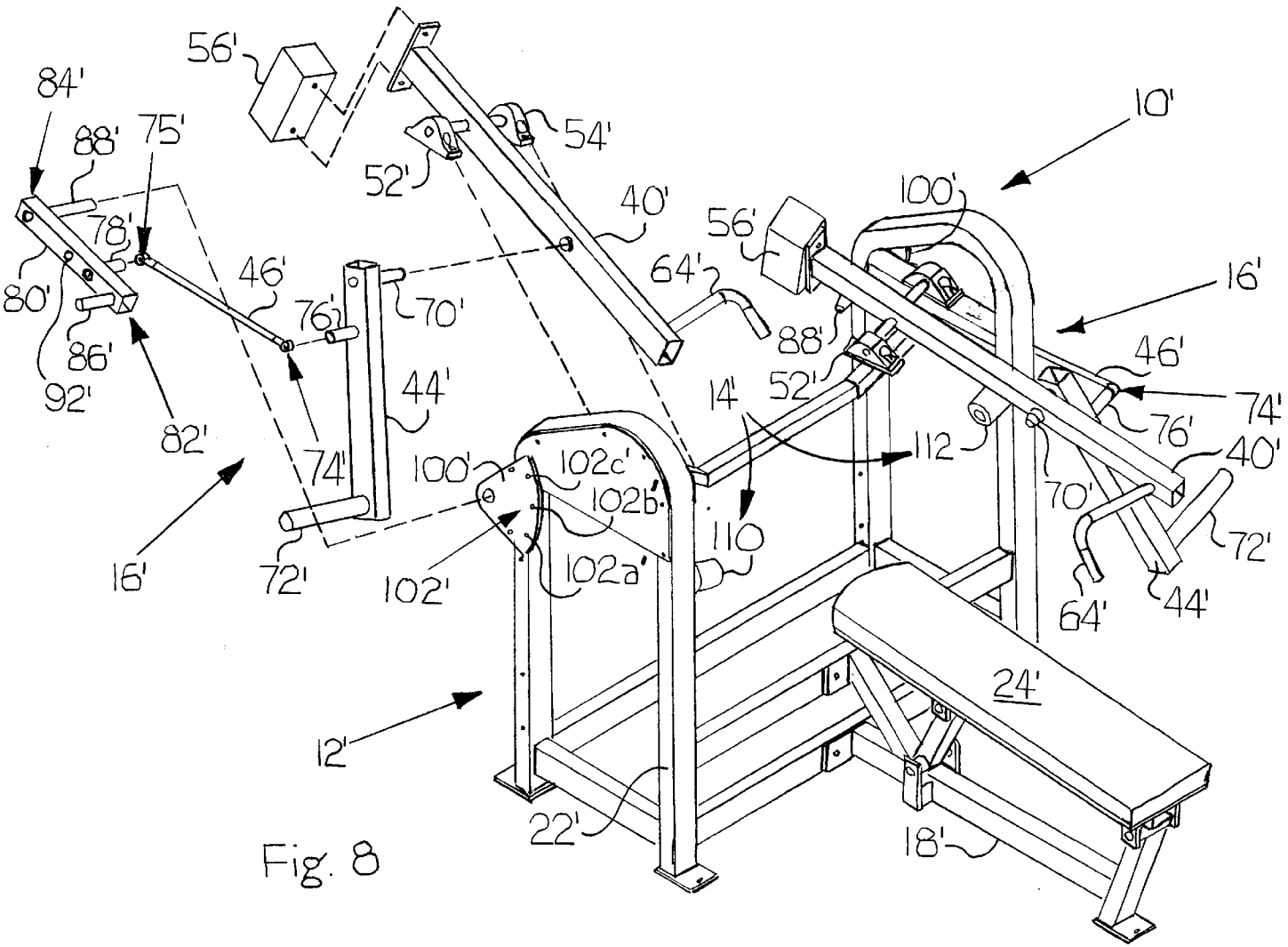
FIG. 8 is an exploded perspective view of an arm press embodiment of the weight training machine according to the present invention.

The above-discussed principle of operation for the leg press embodiment of the weight training machine 10 may also be applied to an arm press embodiment, such as a chest press machine, as shown in FIGS. 8–11. In FIGS. 8–11 the arm press embodiment of the weight training machine is designated with reference character 10'. Referring to FIG. 8, the machine 10' includes a main frame 12' and two laterally spaced lever carriage mechanisms 16'. The main frame 12' includes a seat portion 18' and an upstanding frame portion 22', which is similar in construction to the second frame portion 22 of the machine 10 discussed previously. The seat portion 18' preferably includes a single upholstered pad 24' to support the user's back and hips during use of the machine 10'. The stop mechanism 14' is preferably provided in the form of two oppositely facing stops 110, 112 positioned on the upstanding frame portion 22', which limit the downward movement of the lever carriage mechanisms 16', respectively, toward the seat portion 18'.

Figure 9:
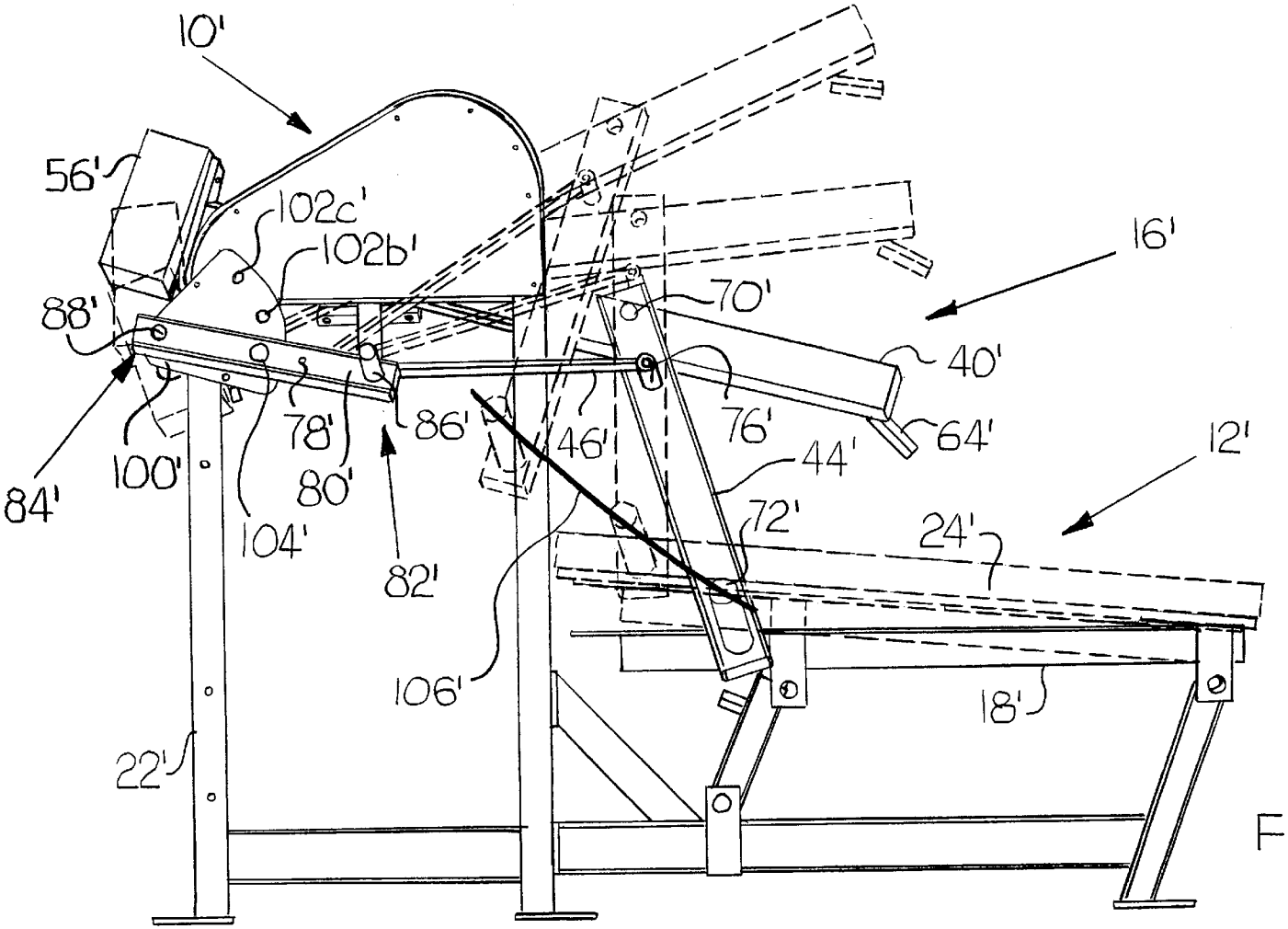
FIG. 9 is a right side elevational view of the weight training machine of FIG. 8 with the adjustment linkage of the machine set in the overload beginning position and showing the range of motion of the lever carriage mechanism in phantom.
Figure 10:
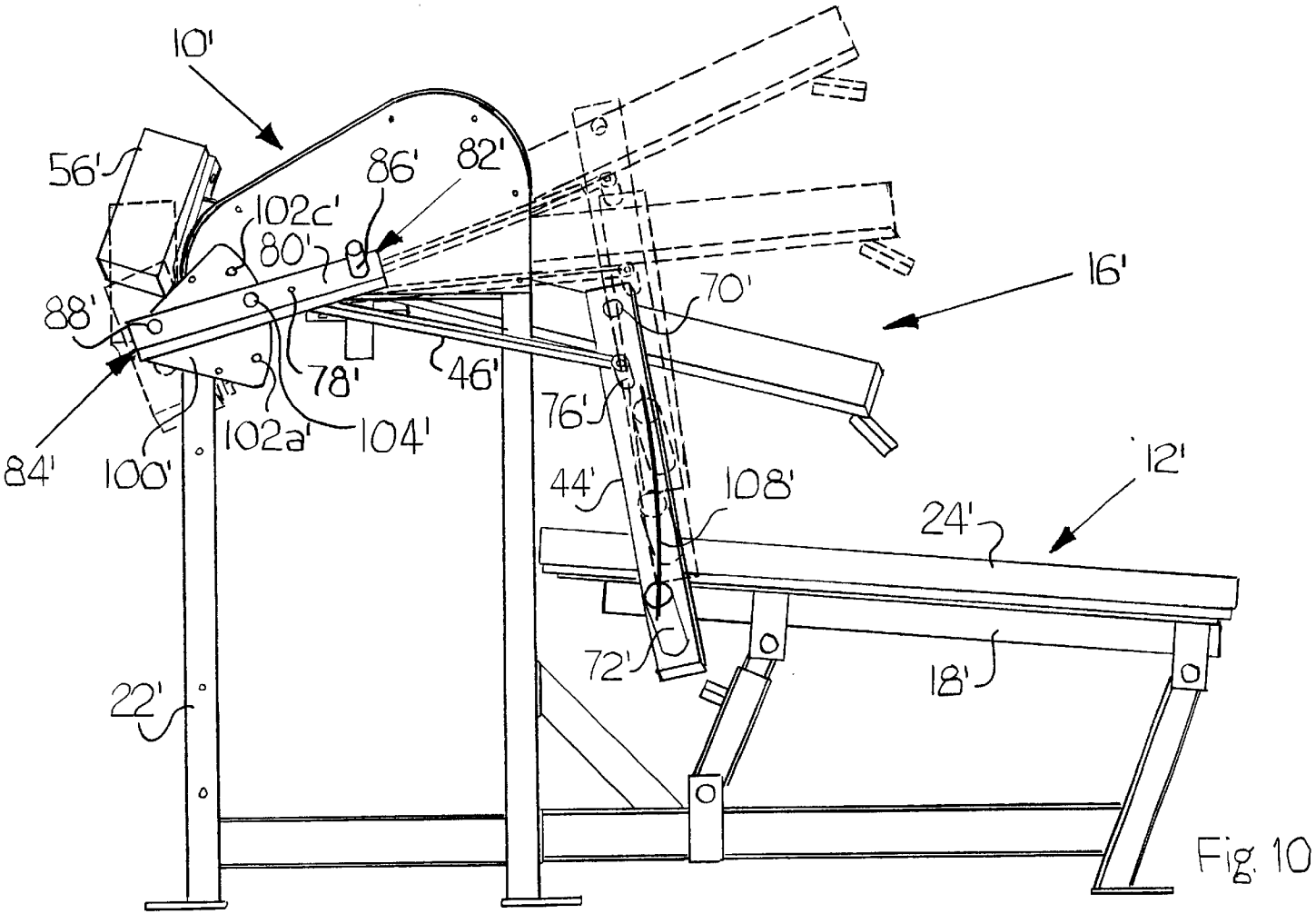
FIG. 10 is a right side elevational view of the weight training machine of FIG. 8 with the adjustment linkage of the machine set in the overload middle position and showing the range of motion of the lever carriage mechanism in phantom.
Figure 11:
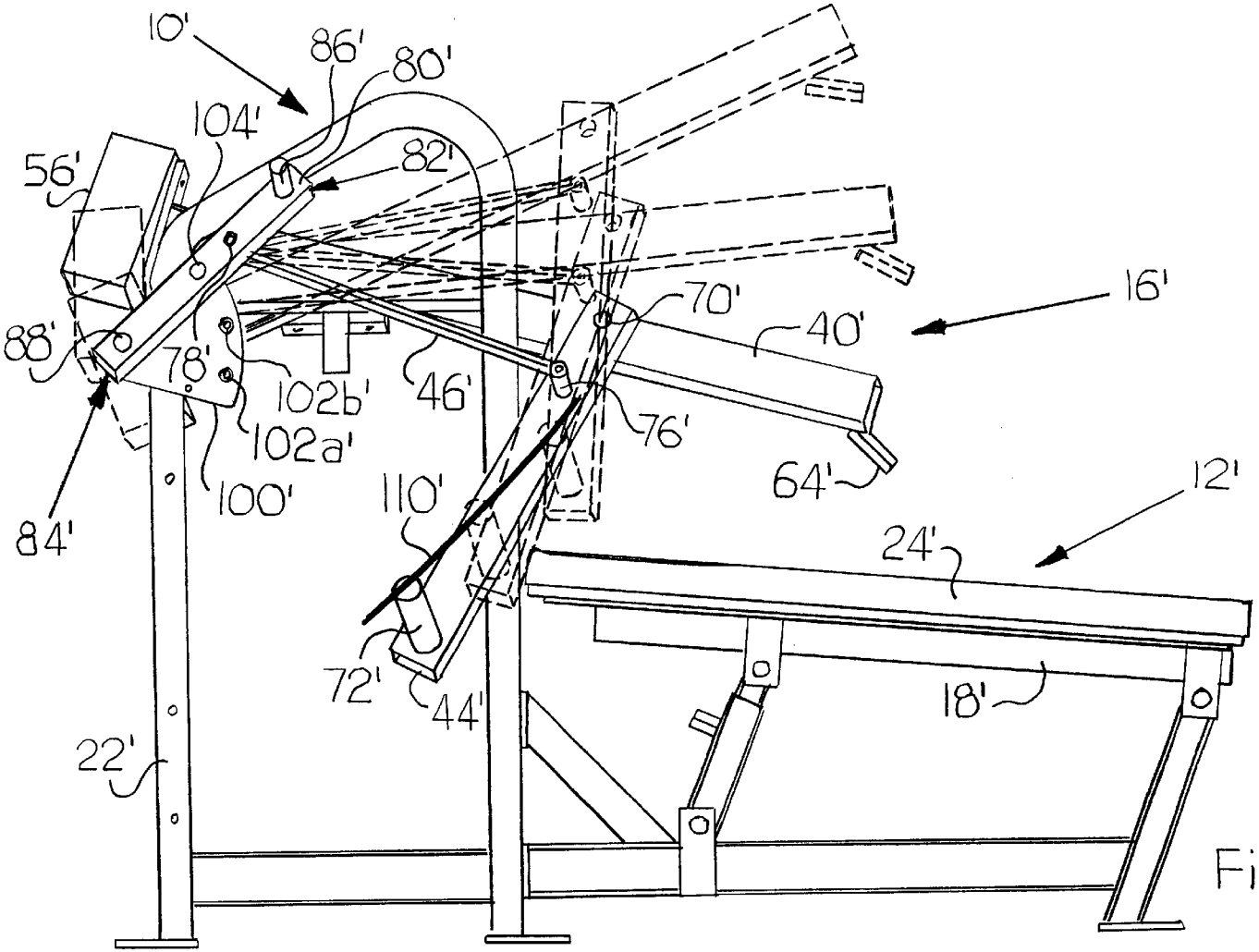
FIG. 11 is a right side elevational view of the weight training machine of FIG. 8 with the adjustment linkage of the machine set in the overload end position and showing the range of motion of the lever carriage mechanism in phantom.

The left and right lever carriage mechanisms 16' each include a main linkage 40' pivotally connected to the frame portion 22', a weight mount lever 44' pivotally connected to the main linkage 40', and a guide linkage 46' also pivotally connected to the main linkage 40'. The right side main linkage 40' is supported and pivotally connected to the frame portion 22' by bearings 52', 54', and the left side main linkage 40' is supported and pivotally connected to the frame portion 22' by a second set of bearings 52', 54'. Right and left sides for the machine 10 are defined from the point of view of the user who will operate the machine 10' in FIG. 8. The user will generally use the machine 10' with his or her back and hips positioned against upholstered pad 24' and head facing the frame portion 22'. Hence, FIGS. 9–11 are right side elevational views of the machine 10.

The main linkage 40' further includes a counterweight portion 56' for each of the respective lever carriage mechanisms 16' which offsets the weight of the respective lever carriage mechanisms 16'. The right and left side main linkages 40' each have a handle grip 64' which the user grasps to provide the input to the machine 10' and, hence, the handle grips 64' are the input mechanisms to the machine 10'. In operation, the user grasps the respective handle grips 64' and pushes upward in a reciprocating manner to pivot the right and left side lever carriage mechanisms 16' and thus raise and lower the weight mount levers 44' attached thereto. As shown in FIG. 8, the right side main linkage 40' coacts with stop 110 to limit the downward motion of the right side lever carriage mechanism 16', and the left side main linkage 40' coacts with stop 112 to limit the downward motion of the left side lever carriage mechanism 16'.

The respective weight mount levers 44' are pivotally connected to the right and left side main linkages 40' and each include a weight mount shaft 72' adapted to receive removable weights onto the machine 10'. The weight mount shafts 72 and the weight mount levers 44' are the weight carrying portions of the right and left side lever carriage mechanisms 16'. The weight mount levers 44' are each pivotally connected by shaft 70' to the respective main linkages 40'.

In the machine 10', the guide linkages 46' for the right and left side lever carriage mechanisms 16' are preferably provided as bars each having a first end 74' and a second end 75'. The first end 74' of the respective guide linkages 46' is pivotally connected to the respective weight mount levers 44'. The second end 75' of the respective guide linkages 46' is pivotally connected to respective right and left side adjustment linkages 80'. The connection point of the guide linkages 46' to weight mount levers 44' may be about 4½ inches away from shafts 76' which connect the weight mount levers 44' to the respective right and left side main linkages 40'.

The adjustment linkages 80' each have a first end 82' and a second end 84'. An adjustment handle lever 86' is preferably connected to the first end 82' of each of the adjustment linkages 80'. The second end 84' of each of the adjustment linkages 80' is pivotally connected by respective shafts 88' to the upstanding frame portion 22' of the main frame 12'. In particular, the adjustment linkages 80' are pivotally connected to respective adjustment plates 100' fixedly secured to the right and left sides of the machine 10'. The guide linkages 46' are pivotal relative to the adjustment linkages 80' via shafts 78' extending from the respective adjustment linkages 80'. The connection point at shaft 78' is about 5½ inches from the first end 82' of the respective adjustment linkages 80'.

The adjustment linkages 80' each define an aperture 92'. The adjustment plates 100' each define a plurality of holes 102'. The arm press embodiment of the machine 10' shown in FIG. 8 includes three holes 102*a*', 102*b*' and 102*c*'. However, as with the machine 10 discussed previously, additional or fewer holes 102' could be provided in adjustment plates 100'. As was the case with machine 10, the adjustment linkage 80' may be set in different overload positions which correspond with adjustment holes 102*a*', 102*b*' and 102*c*' in the adjustment plates 100', as shown in FIGS. 9–11. In addition, as shown in FIGS. 9–11, the lever carriage mechanism 16' has about a 40° range of motion.

FIG. 9 shows the right side adjustment linkage 80' set in the overload beginning position corresponding to hole 102*a*' in the right side adjustment plate 100' by popper pin 104'. FIG. 10 shows the adjustment linkage 80' set in the overload middle position corresponding to hole 102*b*' in the adjustment plate 100'. Finally, FIG. 11 shows the adjustment linkage 80' in the overload end position corresponding to hole 102*c*' in the adjustment plate 100'. The overload positions of the adjustment linkage 80' as set by holes 102*a*', 102*b*' and 102*c*' and popper pin 104' cause the weight mount shaft 72' of the respective weight mount levers 44' to traverse different arcs as the user makes inputs to the machine 10'. FIG. 9 shows the weight mount shaft 72' traversing a first arc 106' with the adjustment linkage 80' set in the overload beginning position corresponding to hole 102*a*' in the adjustment plate 100'. In the overload beginning position, the user will target the pectoral muscles more so than the tricep muscles. FIG. 10 shows the weight mount shaft 72' traversing a second arc 108' with the adjustment linkage 80' set in the overload middle position corresponding to hole 102*b*' in the adjustment plate 100'. In the overload middle position, the user will target pectoral and tricep muscles approximately evenly throughout the range of motion of the lever carriage mechanisms 16'. Finally, FIG. 11 shows the weight mount shaft 72' traversing a third arc 110' with the adjustment linkage 80' set in the overload end position corresponding to hole 102*c*' in the adjustment plate 100'. In the overload end position, the user will target the tricep muscles more so than the pectoral muscles.

The arm press embodiment of the machine 10' operates in a substantially similar manner to the leg press embodiment of the machine 10 discussed previously, and the user will experience similar load resistance percentages in the various overload positions of the machine 10' as found in the leg press machine embodiment. The user operates the machine 10' by pushing upward against the handle grips 64' which causes the respective right and left side lever carriage mechanisms 16' to pivot upward. The main linkages 40' pivot about respective bearings 52', 54', and the weight mount levers 44' rotate upward with the main linkages 40'. The weight mount shafts 72' traverse the respective first arc 106', second arc 108' and third arc 110' shown in FIGS. 4–11, depending on the angle and positioning of the right and left side adjustment linkages 80'. The first end 74' of each of the guide linkages 46' pivot upward with the weight mount levers 44'. The second end 75' of each of the guide linkages 46' simultaneously pivots downward with the second end 84' of the adjustment linkages 80'. The angle and location of the adjustment linkages 80' are selectively variable as discussed previously. The guide linkages 46' transmit the changes in the angle and location of the adjustment linkages 80' to the respective right and left side lever carriage mechanisms 16', which thereby alters the arc traversed by the weight mount levers 72'. In this manner, the user of the machine 10' may selectively vary his or her workout regimen.

Figure 12:
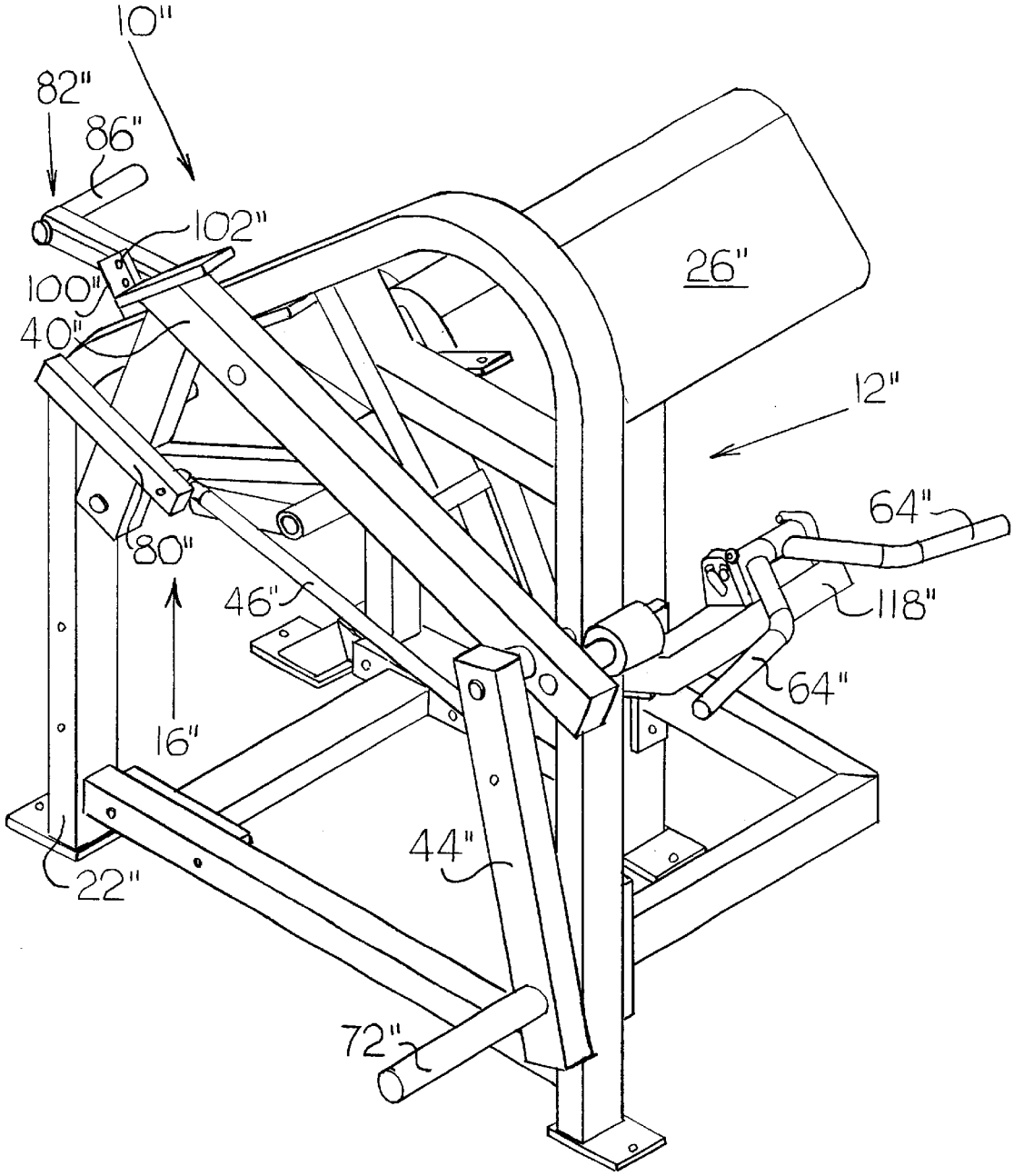
FIG. 12 is a perspective view of an arm curl embodiment of the weight training machine according to the present invention.
Figure 13:
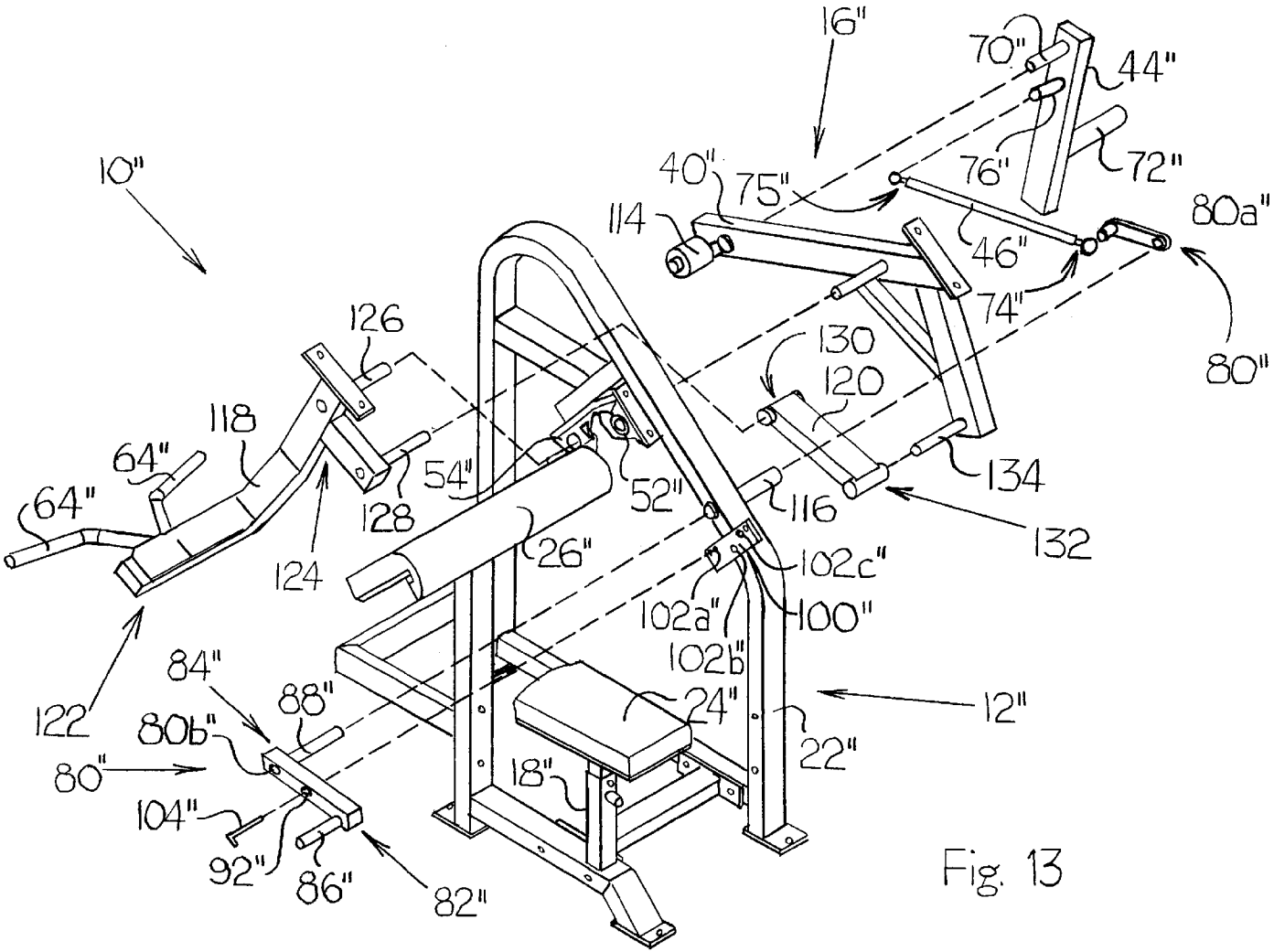
FIG. 13 is an exploded and perspective view of the weight training machine of FIG. 12.

Referring now to FIGS. 12–19, the weight training machine is also an arm curl machine, which is designated with reference character 10" in the figures. Referring, in particular, to FIGS. 12 and 13, the machine includes a main frame 12" and a lever carriage mechanism 16". The main frame 12" includes a seat portion 18" and an upstanding frame portion 22", which is similar in construction to the upstanding frame portion 22' of the arm press machine 10' discussed previously. The seat portion 18" preferably includes a first upholstered pad 24" for the user to sit on while using the machine. The upstanding frame portion 22" further includes a second upholstered pad 26" located to support the user's elbows while using the machine 10". The seat portion 18" is located on a left side of the machine and the lever carriage mechanism 16" is located on the right side of the machine 10". Right and left sides for the machine 10" are defined from the point of view of the user who will operate the machine 10". The user will operate the machine 10" by sitting on the first upholstered pad 24" facing the second upholstered pad 26", and rest his or her elbows on the second upholstered pad 26". Hence, FIGS. 14–19 discussed herein are right side elevational views of the machine 10".

The lever carriage mechanism 16" includes a main linkage 40" pivotally connected to the upstanding frame portion 22", a weight mount lever 44" pivotally connected to the main linkage 40", and a guide linkage 46" also pivotally connected to the main linkage 40". The main linkage 40" is support and pivotally connected to the upstanding frame portion by bearing 52". A stop member 114" is preferably located at one end of the main linkage 40" and is adapted to coact with the upstanding frame portion 22" to limit the downward movement of the lever carriage mechanism 16" toward the seat portion 18".

The weight mount lever 44" is pivotally connected to the main linkage 40" by shaft 70" and includes a weight mount shaft 72" adapted to receive removable weights onto the machine 10". The weight mount shaft 72" and the weight mount lever 44" are the weight carrying portion of the lever carriage mechanism 16".

The guide linkage 46" is formed as a bar having a first end 74" and a second end 75". The first end 74" of the guide linkage 46" is pivotally connected to the weight mount lever 44" via shaft 76". The second end 75" of the guide linkage 46" is pivotally connected to an adjustment linkage 80". The adjustment linkage 80" in the machine 10" is preferably provided in two parts, a first portion 80*a*" and a second portion 80*b*". The first and second portions 80*a*", 80*b*" are connected by shaft 88", which is rotatably received through mechanical tube 116 located on the upstanding frame portion 22". The guide linkage 46" is pivotally connected to the first portion 80*a*" of the adjustment linkage 80" via shaft 78", which extends from the first portion 80*a*". The second portion 80*b*" of the adjustment linkage 80" includes a first end 82" and a second end 84". An adjustment handle lever 86" is located at the first end 82" of the second portion 80*b*". Shaft 88" is located at the second end 84" of the second portion 80*b*". The second portion 80*b*" of the adjustment linkage 80" defines an aperture 92". An adjustment plate 100" is attached to the upstanding frame portion 22" and defines a plurality of adjustment holes 102". The adjustment plate 100" in FIG. 13 includes three adjustment holes 102*a*", 102*b*" and 102*c*". However, additional or fewer holes 102" may be provided in the adjustment plate 100" in accordance with the present invention. The adjustment linkage 80" may be set in different overload positions which correspond with the adjustment holes 102*a*", 102*b*" and 102*c*" in the adjustment plate 100" by use of a pin 104" as was the case with the arm press machine 10' discussed previously.

The main differences between the arm press machine 10' and the present arm curl machine 10" are that the arm curl machine 10" includes a handle grip lever 118 that is pivotally connected to the upstanding frame portion 22" and pivotally connected to a conversion linkage 120. The conversion linkage 120, in turn, is pivotally connected to the lever carriage mechanism 16", and the main linkage 40" in particular. The handle grip lever 118 includes handle grips 64" located at a first end 122 thereof for manipulating the handle grip lever 120. A second end 124 of the handle grip lever 118 includes two shafts, a first shaft 126 which is pivotally supported on the upstanding frame portion 22" by bearing 54", and a second shaft 128 pivotally connected to a first end 130 of the conversion linkage 120. A second end 132 of the conversion linkage 120 is pivotally connected by shaft 134 to the main linkage 40" and, hence, the lever carriage mechanism 16". The conversion linkage 120 pivotally connects the handle grip lever 118 to the lever carriage mechanism 16". The conversion linkage 120 is adapted to convert the pivotal input movement of the handle grip lever 118 by the user to pivotal output movement of the lever carriage mechanism 16". The conversion linkage 118 is adapted to pivot, or rotate, at a slower rate than the handle grip lever 118 which causes the lever carriage mechanism 16" to pivot or rotate at a slower rate than the handle grip lever 118. Thus, the rotational movement, or range of movement of the lever carriage mechanism 16" is approximately half the rotational movement, or range of motion of the handle grip lever 118, (i.e., when the handle grip lever is rotated 140° the lever carriage mechanism is rotated about 70°, for example).

In operation, the user sits on the first upholstered pad 24", grasps the handle grips 64" and pulls upward in a reciprocating manner to pivot the lever carriage mechanism 16" and thus raise and lower the weight mount lever 44" and weight shaft 72". The user will typically rest his or her elbows on the second upholstered pad 26". The stop member 114 attached to the main linkage 40" limits the downward motion of the lever carriage mechanism 16" at the conclusion of the user's movements.

Figure 14:
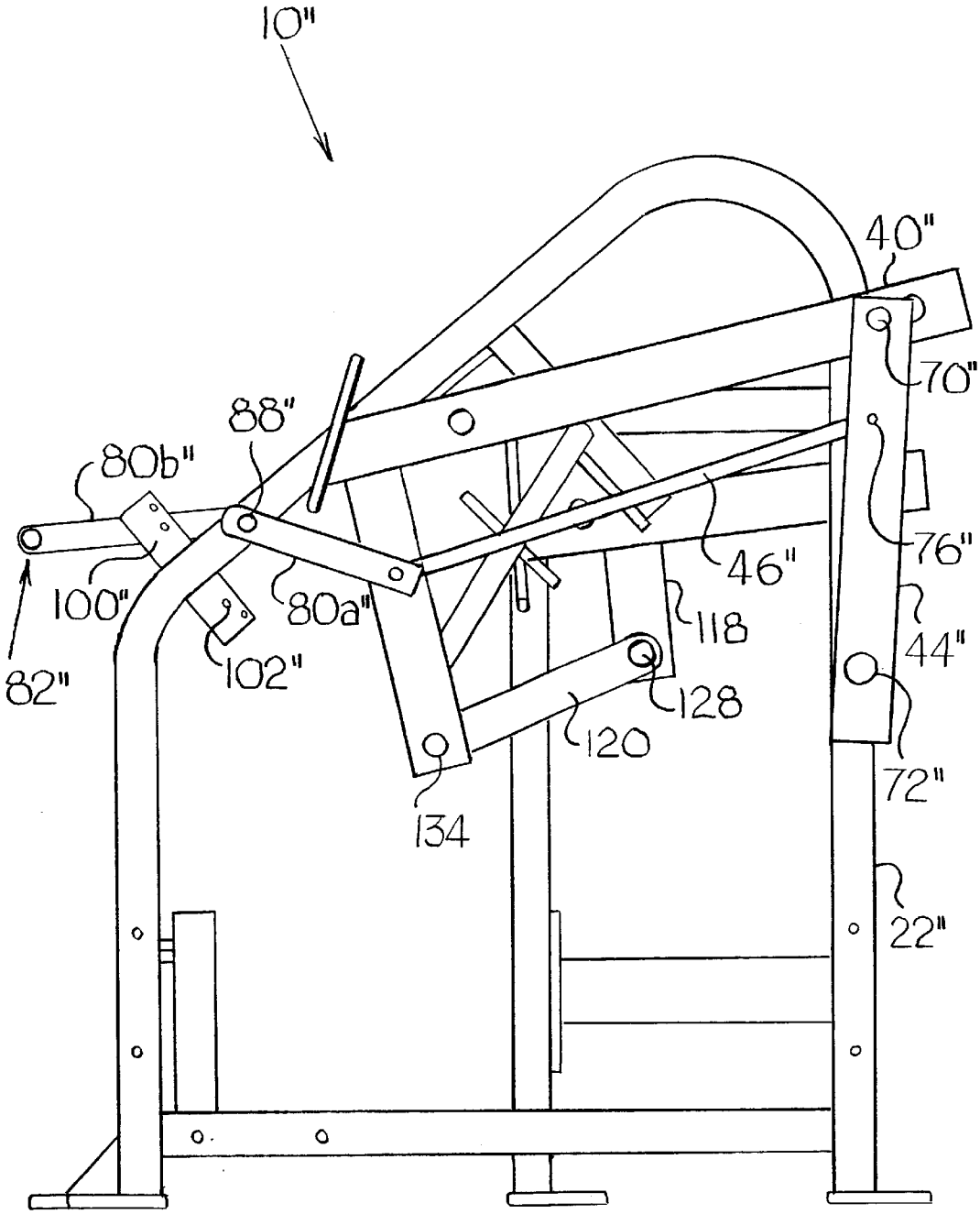
FIG. 14 is a right side elevational view of the weight training machine of FIG. 12 with the adjustment linkage of the machine set in the overload beginning position and showing the lever carriage mechanism at a first rotational position.
Figure 15:
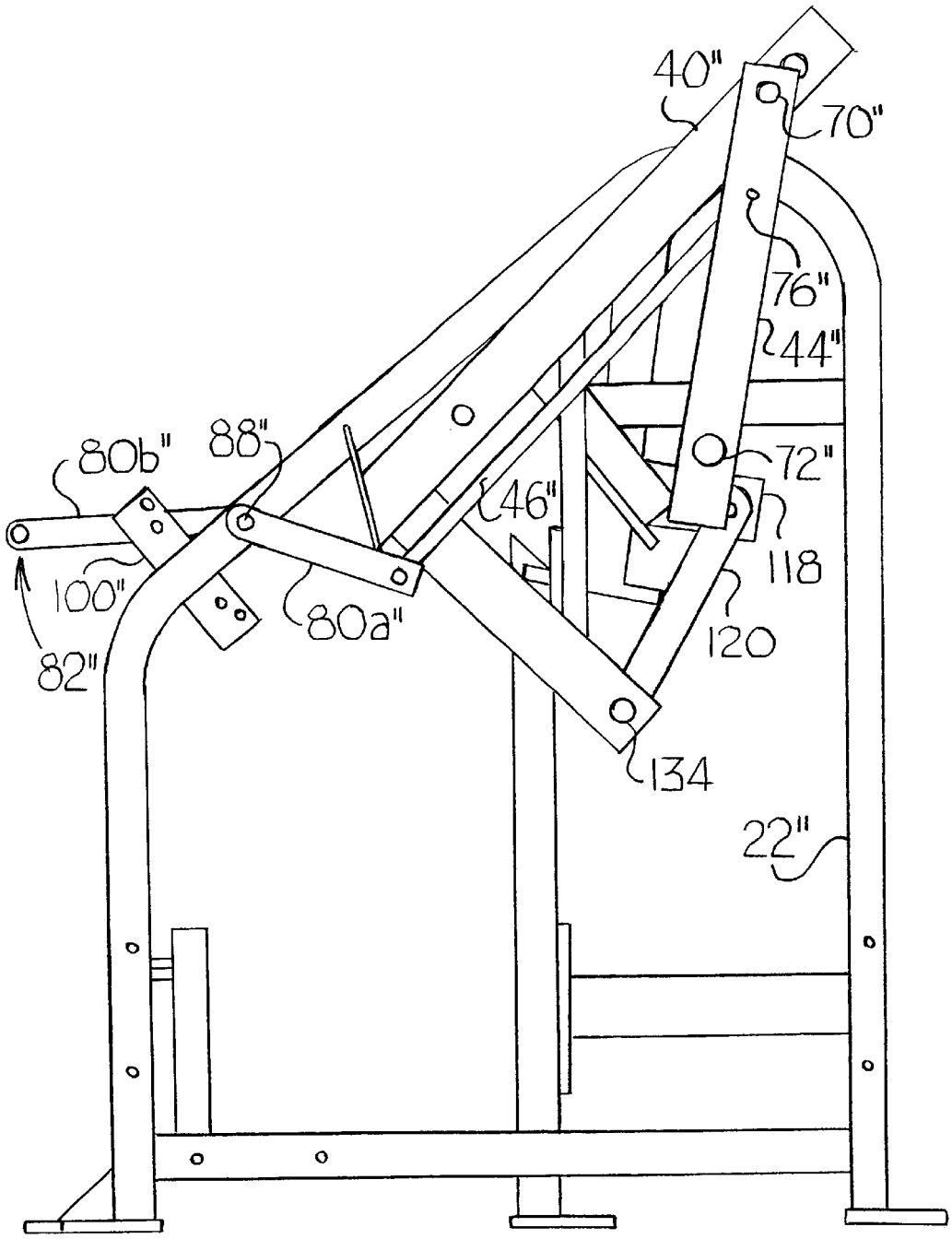
FIG. 15 is a right side elevational view of the weight training machine of FIG. 14 showing the lever carriage mechanism at a second rotational position.
Figure 16:
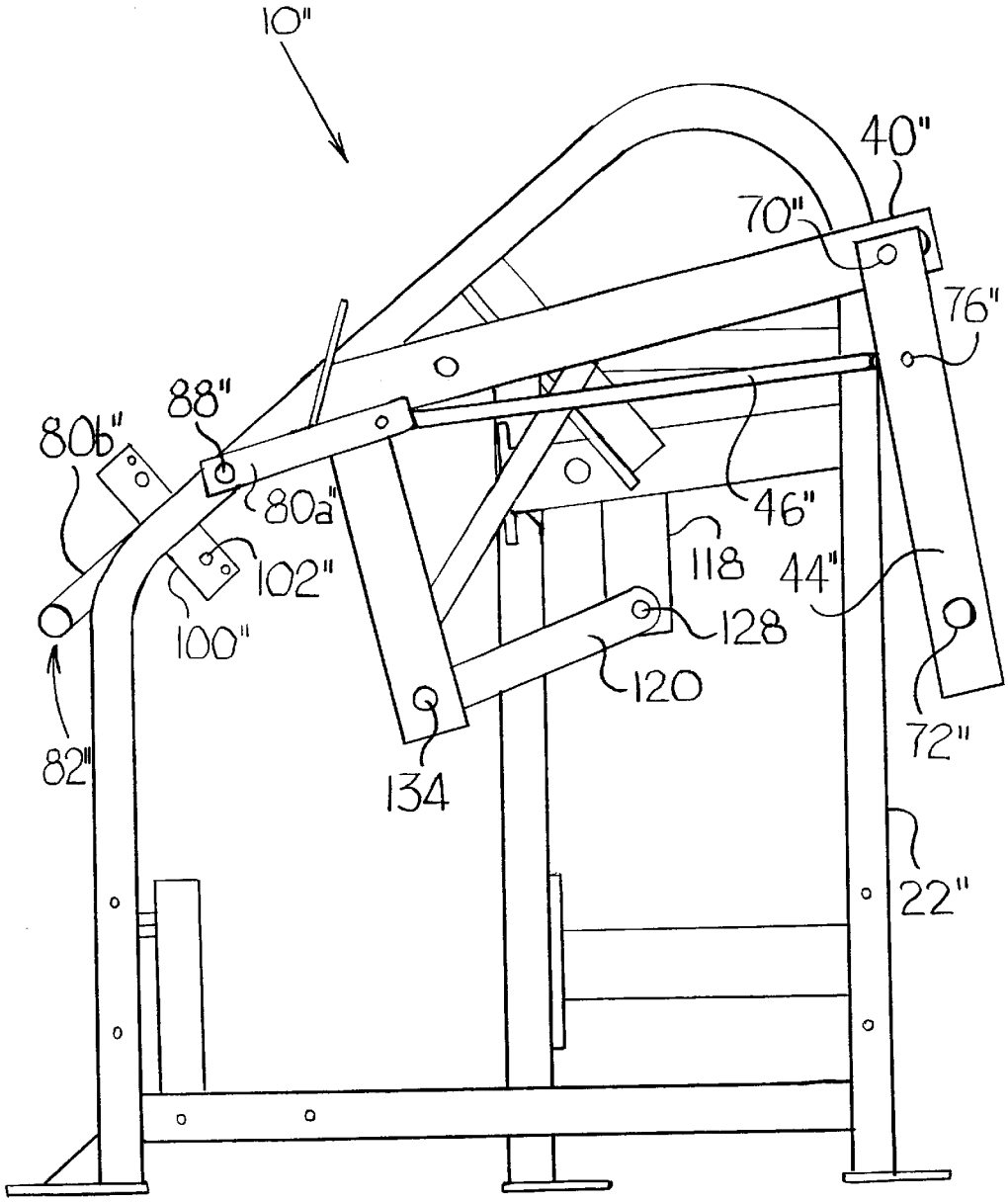
FIG. 16 is a right side elevational view of the weight training machine of FIG. 12 with the adjustment linkage of the machine set in the overload middle position and showing the lever carriage mechanism at a first rotational position.
Figure 17:
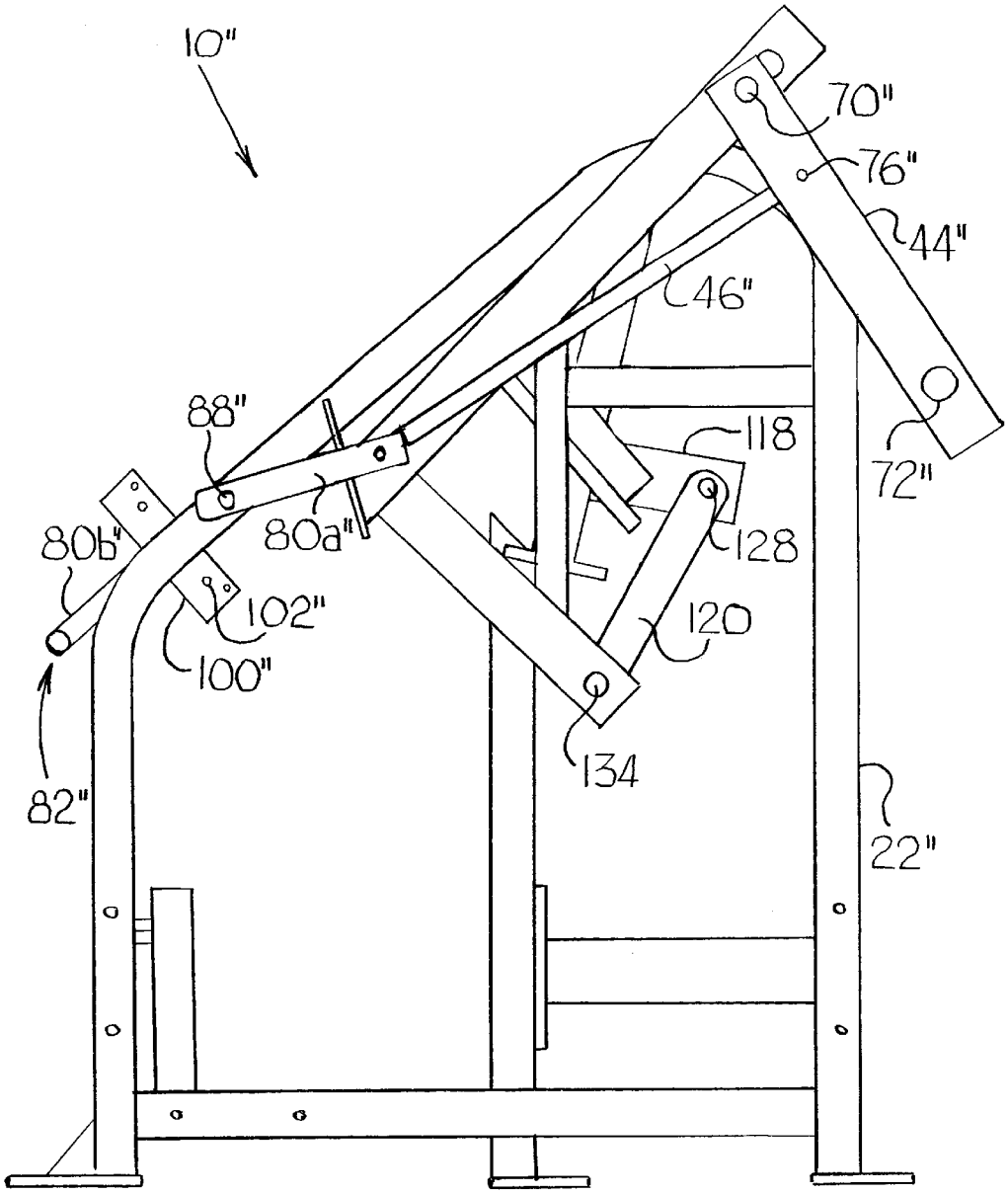
FIG. 17 is a right side elevational view of the weight training machine of FIG. 16 showing the lever carriage mechanism at a second rotational position.
Figure 18:
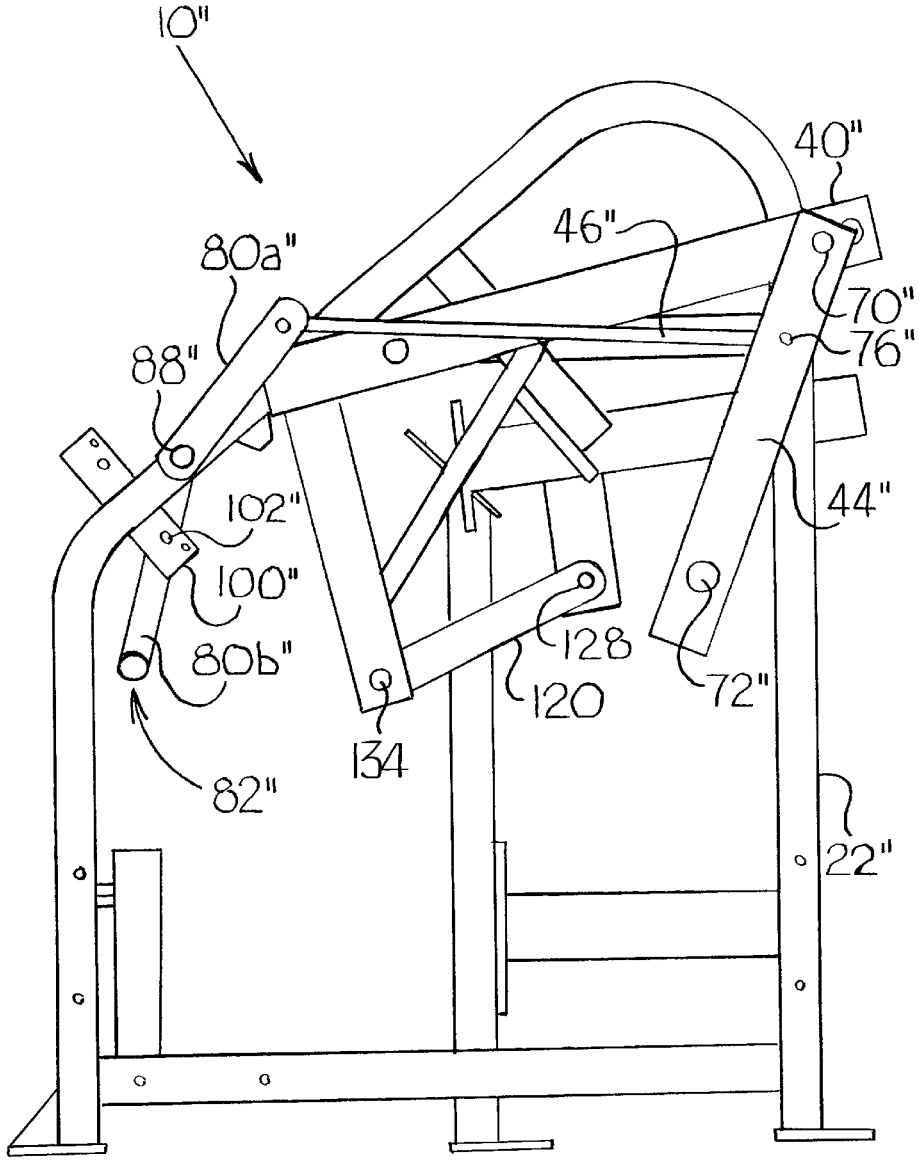
FIG. 18 is a right side elevational view of the weight training machine of FIG. 12 with the adjustment linkage of the machine set in the overload end position and showing the lever carriage mechanism at a first rotational position.
Figure 19:
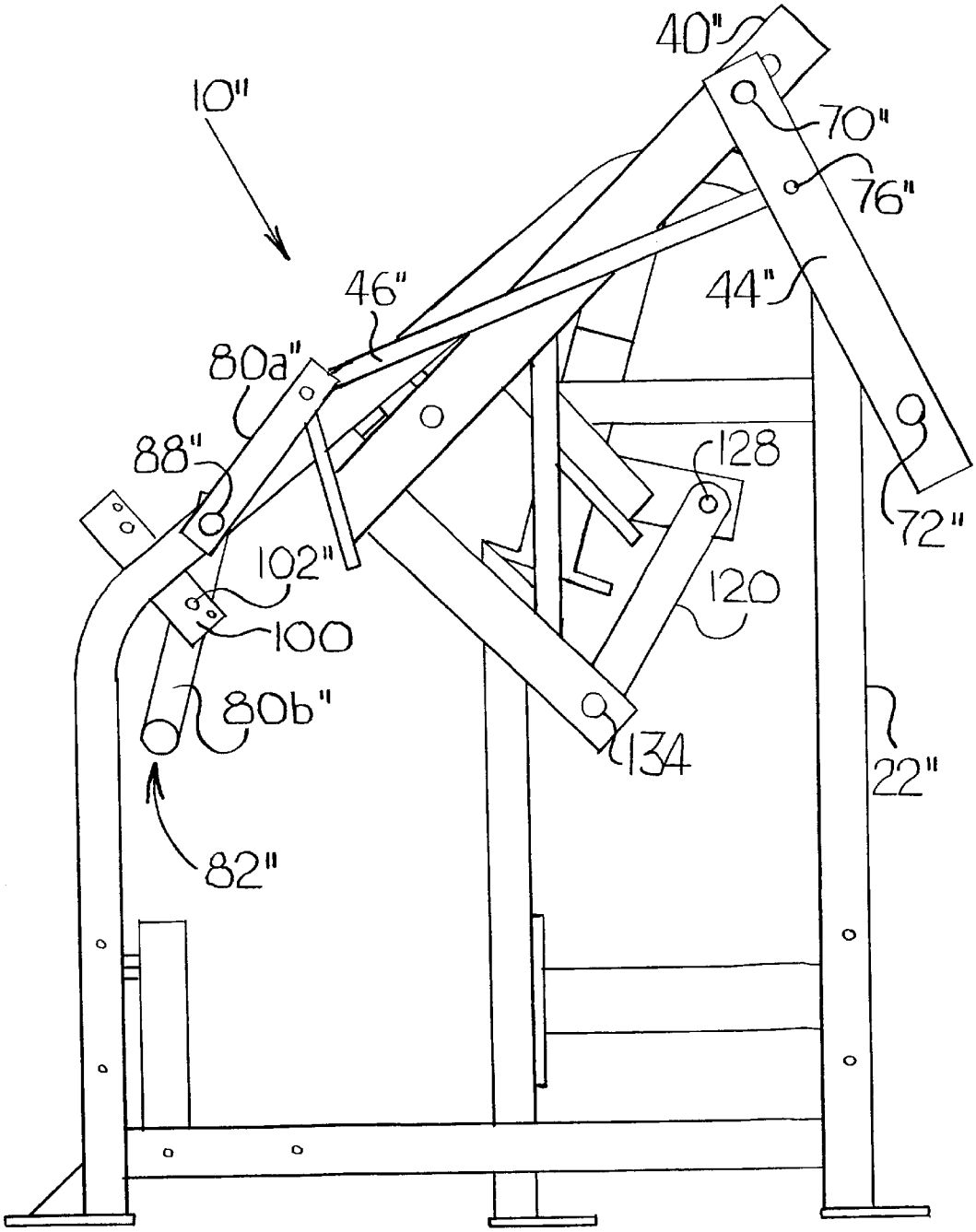
FIG. 19 is a right side elevational view of the weight training machine of FIG. 18 showing the lever carriage mechanism at a second rotational position.

FIGS. 14 and 15 show the adjustment linkage 80" set in the overload beginning position corresponding to hole 102*a*" (shown in FIG. 13) in the adjustment plate 100". FIGS. 16 and 17 show the adjustment linkage 80" set in the overload middle position corresponding to hole 102*b*" in the adjustment plate 100". Finally, FIGS. 18 and 19 show the adjustment linkage 80" in the overload end position corresponding to hole 102*c*" in the adjustment plate 100". The overload positions of the adjustment linkage 80" as set by holes 102*a*", 102*b*" and 102*c*" and pin 104" (shown in FIG. 13) cause the weight mount shaft 72" of the weight mount lever 44" to traverse arcs as the user makes inputs with the handle grip lever 118.

As stated, the conversion linkage 120 is configured to reduce the rotational movement of the lever carriage mechanism 16" to approximately half that of the rotational movement of the handle grip lever 118. FIG. 14 shows the orientation of the lever carriage mechanism 16" with the handle grip lever 118 pivoted to about 70° of rotation. In FIG. 14, with handle grip lever 118 rotated to about 70° the lever carriage mechanism 16" rotates or pivots to approximately 35°, with respect to a horizontal plane (i.e., the ground). FIG. 15 shows the position of the lever carriage mechanism 16" with the handle grip lever 118 at approximately 140° of rotation. The lever carriage mechanism 16" in FIG. 15 rotates to approximately 70° of rotation. Hence, it will be apparent from FIGS. 14 and 15 that the weight mount shaft 72" moves in an arcuate manner from the first rotational position shown in FIG. 14, which corresponds to approximately a midpoint through the range of motion of the lever carriage mechanism 16", to the second rotational position shown in FIG. 15 of the lever carriage mechanism 16", which corresponds to approximately an end point of the range of motion of the lever carriage mechanism 16".

FIGS. 16 and 17 show a similar pivotal movement of the lever carriage mechanism 16" to that shown in FIGS. 14 and 15, but now the adjustment linkage 80" is set in the overload middle position corresponding to adjustment hole 102*b*" (shown in FIG. 13). FIG. 16 shows the lever carriage mechanism 16" with the handle grip lever 118 rotated to approximately 70° of rotation. The lever carriage mechanism 16" in FIG. 16 has rotated, correspondingly, to approximately 35° of rotation. FIG. 17 shows the position of the lever carriage mechanism 16" when the handle grip lever 118 is rotated approximately 140°. It will be apparent that the weight mount shaft 72" exhibits a different arcuate movement from FIG. 16 to FIG. 17 than was the case with FIGS. 14 and 15 discussed previously.

FIGS. 18 and 19 show the position of the lever carriage mechanism 16" with the adjustment linkage set in the overload end position corresponding to hole 102*c*" (shown in FIG. 13) and the handle grip lever 118 rotated to about 70° and 140° respectively. The weight mount shaft 72" exhibits a different arcuate motion from FIG. 18 to FIG. 19 than that shown in FIGS. 14–17 discussed previously.

As will be appreciated by those skilled in the art, the present invention provides a weight training machine that enables the user to selectively target muscle groups in the user's body and vary his or her workout regimen. It is also envisioned that the invention is applicable to machines for physical therapy, in addition to "eight training" per se.

The present invention was described with reference to preferred embodiments, which are merely illustrative of the present invention and not restrictive thereof. Obvious modifications and alterations of the present invention may be made without departing from the spirit and scope of the present invention. The scope of the present invention is defined by the appended claims and equivalents thereto.

I claim:

1. A weight training machine, comprising:

a main frame having a seat portion;

a lever carriage mechanism pivotally connected to the main frame, with the lever carriage mechanism having a weight carrying portion adapted to carry at least one weight;

an input mechanism connected to the lever carriage mechanism; and an adjustment linkage pivotally connected to the lever carriage mechanism and the main frame and configured to selectively adjust an arc of rotation of the weight carrying portion of the lever carriage mechanism about the main frame such that the weight carrying portion may selectively traverse each of a plurality of predefined strength curves in response to movement of the input mechanism by a user.

2. The weight training machine of claim 1, further including a stop mechanism connected to the main frame, wherein the stop mechanism is configured to coact with the lever carriage mechanism such that the stop mechanism limits rotation of the lever carriage mechanism in a direction toward the seat portion of the main frame.

3. The weight training machine of claim 2, wherein the stop mechanism is pivotally connected to the main frame.

4. The weight training machine of claim 3, wherein the stop mechanism further includes an L-shaped engagement handle for manipulating the stop mechanism.

5. The weight training machine of claim 1, wherein the lever carriage mechanism includes a main linkage pivotally supported on the main frame by bearings.

6. The weight training machine of claim 5, wherein the lever carriage mechanism includes a weight mount lever pivotally connected to the main linkage, and wherein the weight mount lever includes a weight shaft for receiving one or more removable weights onto the machine.

7. The weight training machine of claim 5, wherein the input mechanism includes a push platform pivotally connected to the main linkage and configured to transmit user input to the machine.

8. The weight training machine of claim 5, wherein the input mechanism includes a handle grip fixedly attached to the main linkage and configured to transmit user input to the machine.

9. The weight training machine of claim 7, wherein the lever carriage mechanism includes a following linkage pivotally connected to the push platform and the main frame, and wherein the following linkage controls an angle of the push platform relative to a horizontal plane as the lever carriage mechanism rotates about the main frame when the machine is operated by the user.

10. The weight training machine of claim 1, further including a guide linkage pivotally connected to the adjustment linkage and the weight carrying portion of the lever carriage mechanism, and wherein the guide linkage guides the weight carrying portion along the preselected strength curve when the machine is operated by a user.

11. The weight training machine of claim 10, wherein the weight carrying portion includes a weight mount lever with a weight shaft for receiving one or more removable weights onto the machine.

12. The weight training machine of claim 10, wherein the guide linkage includes a first end and a second end, and wherein the first end is pivotally connected to the weight carrying portion of the lever carriage mechanism and the second end is pivotally connected to the adjustment linkage.

13. The weight training machine of claim 1, further including an adjustment plate fixed to the main frame, with the adjustment plate defining a plurality of adjustment holes, wherein the adjustment linkage defines an aperture, and wherein a removable pin cooperates with the aperture and one of the holes in the adjustment plate to set the arc of rotation of the weight carrying portion of the lever carriage mechanism and the corresponding predefined strength curve.

14. The weight training machine of claim 13, wherein a first hole of the plurality of adjustment holes corresponds to an overload beginning position of the adjustment linkage, a second hole of the plurality of adjustment holes corresponds to an overload middle position of the adjustment linkage, and a third hole of the plurality of adjustment holes corresponds to an overload end position of the adjustment linkage.

15. The weight training machine of claim 1, wherein the main frame includes a projecting piece, and wherein the adjustment linkage is pivotally connected to the projecting piece.

16. The weight training machine of claim 5, wherein the main linkage includes a counterweight portion at one end thereof.

17. The weight training machine of claim 5, wherein the main linkage includes a depending stop member configured to coact with a stop mechanism connected to the main frame, with the stop mechanism limiting rotation of the lever carriage mechanism toward the seat portion.

18. A leg press machine, comprising:

a main frame having a seat portion, a first frame portion adjacent the seat portion, and a second frame portion upstanding from the first frame portion;

a lever carriage mechanism pivotally connected to the second frame portion of the main frame, with the lever carriage mechanism having a weight carrying portion adapted to carry at least one weight;

an input mechanism connected to the lever carriage mechanism;

an adjustment plate fixed to the second frame portion; and an adjustment linkage pivotally connected to the lever carriage mechanism and the adjustment plate and configured to selectively adjust an arc of rotation of the weight carrying portion of the lever carriage mechanism about the second frame portion such that the weight carrying portion may selectively traverse each of a plurality of predefined strength curves in response to movement of the input mechanism by a user.

19. The weight training machine of claim 18, further including a stop mechanism connected to the main frame, wherein the stop mechanism is configured to coact with the lever carriage mechanism such that the stop mechanism limits rotation of the lever carriage mechanism in a direction toward the seat portion of the main frame.

20. The weight training machine of claim 19, wherein the stop mechanism is pivotally connected to the main frame.

21. The weight training machine of claim 1, wherein the lever carriage mechanism includes a main linkage pivotally supported on the main frame by bearings.

22. The weight training machine of claim 21, wherein the lever carriage mechanism includes a weight mount lever pivotally connected to the main linkage, and wherein the weight mount lever includes a weight shaft for receiving one or more removable weights onto the machine.

23. The weight training machine of claim 21, wherein the input mechanism includes a push platform pivotally connected to the main linkage and configured to transmit user input to the machine.

24. The weight training machine of claim 21, wherein the input mechanism includes a handle grip fixedly attached to the main linkage and configured to transmit user input to the machine.

25. The weight training machine of claim 24, wherein the lever carriage mechanism includes a following linkage pivotally connected to the push platform and the main frame, and wherein the following linkage controls an angle of the push platform relative to a horizontal plane as the lever carriage mechanism rotates about the main frame when the machine is operated by the user.

26. The weight training machine of claim 18, further including a guide linkage pivotally connected to the adjustment linkage and the weight carrying portion of the lever carriage mechanism, and wherein the guide linkage guides the weight carrying portion along the preselected strength curve when the machine is operated by a user.

27. The weight training machine of claim 26, wherein the guide linkage includes a first end and a second end, and wherein the first end is pivotally connected to the weight carrying portion of the lever carriage mechanism and the second end is pivotally connected to the adjustment linkage.

28. The weight training machine of claim 18, further including an adjustment plate fixed to the main frame, with adjustment plate defining a plurality of adjustment holes, wherein the adjustment linkage defines an aperture, and wherein a removable pin cooperates with the aperture and one of the holes in the adjustment plate to set the arc of rotation of the weight carrying portion of the lever carriage mechanism and the corresponding predefined strength curve.

29. The weight training machine of claim 28, wherein a first hole of the plurality of adjustment holes corresponds to an overload beginning position of the adjustment linkage, a second hole of the plurality of adjustment holes corresponds to an overload middle position of the adjustment linkage, and a third hole of the plurality of adjustment holes corresponds to an overload end position of the adjustment linkage.

30. The weight training machine of claim 21, wherein the main linkage includes a counterweight portion at one end thereof.

31. The weight training machine of claim 21, wherein the main linkage includes a depending stop member configured to coact with a stop mechanism connected to the main frame, with the stop mechanism limiting rotation of the lever carriage mechanism toward the seat portion.

* * * * *